US009219311B2

(12) United States Patent
Yanagi et al.

(10) Patent No.: US 9,219,311 B2
(45) Date of Patent: Dec. 22, 2015

(54) ANTENNA DEVICE HAVING ANTENNA ELEMENT AND GROUND ELEMENT DEFINING PLANAR RECTANGULAR REGION WITH GAP THEREBETWEEN

(75) Inventors: Masahiro Yanagi, Shinagawa (JP); Shigemi Kurashima, Shinagawa (JP); Hideaki Yoda, Shinagawa (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 312 days.

(21) Appl. No.: 12/849,994

(22) Filed: Aug. 4, 2010

(65) Prior Publication Data

US 2011/0032155 A1 Feb. 10, 2011

(30) Foreign Application Priority Data

Aug. 10, 2009 (JP) ..... 2009-185584
Mar. 31, 2010 (JP) ..... 2010-082791

(51) Int. Cl.

| | |
|---|---|
| ***H01Q 1/38*** | (2006.01) |
| ***H01Q 9/40*** | (2006.01) |
| ***H01Q 1/48*** | (2006.01) |
| ***H01Q 21/28*** | (2006.01) |

(52) U.S. Cl.
CPC . *H01Q 9/40* (2013.01); *H01Q 1/48* (2013.01); *H01Q 21/28* (2013.01)

(58) Field of Classification Search
CPC ..... H01Q 1/48; H01Q 21/28; H01Q 9/40
USPC ..... 343/700 MS, 700, 767, 769, 771
IPC ..... H01Q 1/48,21/28, 9/40
See application file for complete search history.

(56) References Cited

U.S. PATENT DOCUMENTS

| | | | | |
|---|---|---|---|---|
| 4,131,894 | A * | 12/1978 | Schiavone | 343/700 MS |
| 4,170,013 | A * | 10/1979 | Black | 343/700 MS |
| 7,187,329 | B2 * | 3/2007 | Okado | 343/700 MS |
| 2005/0156788 | A1 * | 7/2005 | Lin | 343/700 MS |
| 2006/0103577 | A1 * | 5/2006 | Lee | 343/700 MS |

FOREIGN PATENT DOCUMENTS

| | | |
|---|---|---|
| EP | 01564842 | 8/2005 |
| JP | 40-026729 | 11/1965 |
| JP | 2003-101332 | 4/2003 |
| JP | 2006-19979 | 1/2006 |
| JP | 2006-121643 | 5/2006 |
| WO | WO03/103087 | 12/2003 |

* cited by examiner

*Primary Examiner* — Sue A Purvis
*Assistant Examiner* — Jae Kim
(74) *Attorney, Agent, or Firm* — IPUSA, PLLC

(57) ABSTRACT

An antenna device includes an antenna element to be fed with electric power from an external power supply and a ground element to be coupled to the antenna element. The antenna element and the ground element are formed of a conductive film and arranged to define a rectangular region in a plan view with at least one gap between the antenna element and the ground element. The antenna element has a shape of one of a polygon, a circle, and a part of the polygon or the circle. The antenna element includes a feeding part in its portion close to the ground element.

5 Claims, 31 Drawing Sheets

FIG.5A

| POLARIZATION PLANE | FREQUENCY(GHz) | 3 | 3.5 | 4 | 4.5 | 5 |
|---|---|---|---|---|---|---|
| VERTICAL | MAX | −13.2 | −8.0 | −5.3 | −5.6 | −6.7 |
| | AVG | −15.1 | −9.0 | −6.4 | −7.2 | −9.0 |
| | MIN | −16.8 | −10.5 | −7.8 | −9.4 | −13.0 |

FIG.5B

| POLARIZATION PLANE | FREQUENCY(GHz) | 3 | 3.5 | 4 | 4.5 | 5 |
|---|---|---|---|---|---|---|
| HORIZONTAL | MAX | −11.3 | −6.6 | −4.9 | −4.9 | −5.3 |
| | AVG | −14.8 | −10.7 | −9.4 | −8.9 | −8.9 |
| | MIN | −44.4 | −39.5 | −50.3 | −44.7 | −37.8 |

ANTENNA DEVICE HAVING ANTENNA ELEMENT AND GROUND ELEMENT DEFINING PLANAR RECTANGULAR REGION WITH GAP THEREBETWEEN

CROSS-REFERENCE TO RELATED APPLICATIONS

The present application is based upon and claims the benefit of priority of Japanese Patent Application No. 2009-185584, filed on Aug. 10, 2009, and Japanese Patent Application No. 2010-082791, filed on Mar. 31, 2010, the entire contents of which are incorporated herein by reference.

BACKGROUND OF THE INVENTION

1. Field of the Invention

The present invention relates to an antenna device that performs close-range communications in a broad band.

2. Description of the Related Art

Conventionally, a communication sheet has been provided that has multiple proximity coupling parts and multiple relay communications circuits provided on a flat surface, where each of the relay communications circuits forms a communications network with the proximity coupling parts and the other relay communications circuits. This communication sheet, when coming into contact with or coming close to another communication sheet, performs data communications with the other communication sheet via the proximity coupling parts. Such a communication sheet has been proposed to construct a radio communications network such as a wireless LAN (local area network). (See, for example, Japanese Laid-Open Patent Application No. 2006-19979.)

SUMMARY OF THE INVENTION

According to one aspect of the present invention, an antenna device includes an antenna element to be fed with electric power from an external power supply and a ground element to be coupled to the antenna element, wherein the antenna element and the ground element are formed of a conductive film and arranged to define a rectangular region in a plan view with at least one gap between the antenna element and the ground element, the antenna element has a shape of one of a polygon, a circle, and a part of the polygon or the circle, and the antenna element includes a feeding part in a portion thereof close to the ground element.

The object and advantages of the embodiments will be realized and attained by means of the elements and combinations particularly pointed out in the claims.

It is to be understood that both the foregoing general description and the following detailed description are exemplary and explanatory and not restrictive of the invention, as claimed.

BRIEF DESCRIPTION OF THE DRAWINGS

Other objects, features and advantages of the present invention will become more apparent from the following detailed description when read in conjunction with the accompanying drawings, in which:

FIG. 4A illustrates the angular distribution of the vertical polarization (x-y plane directivity) of the antenna device and FIG. 4B illustrates the angular distribution of the horizontal polarization (y-z plane directivity) of the antenna device;

FIG. 5A is a table illustrating the maximum value (MAX), the average value (AVG), and the minimum value (MIN) of the gain of the vertical polarization of the antenna device by communication frequency according to the first embodiment of the present invention;

FIG. 5B is a table illustrating the maximum value (MAX), the average value (AVG), and the minimum value (MIN) of the gain of the horizontal polarization of the antenna device by communication frequency according to the first embodiment of the present invention;

FIG. 11A is a top plan view of the antenna device and FIG. 11B is a bottom plan view of the antenna device;

FIG. 12A is a top plan view of the variation of the antenna device and FIG. 12B is a bottom plan view of the variation of the antenna device;

DETAILED DESCRIPTION OF THE PREFERRED EMBODIMENTS

Depending on the form of communications, it may be desirable to perform communications in a highly confidential manner only in a so-called near field.

It is difficult, however, to perform highly confidential communications using the conventional communication sheet because the conventional communication sheet employs capacitive coupling or inductive coupling and may therefore suffer a leakage of magnetic waves.

According to one aspect of the present invention, an antenna device is provided that performs communications in a highly confidential manner.

A description is given below, with reference to the accompanying drawings, of embodiments of the present invention.

[a] First Embodiment

Figure 1:
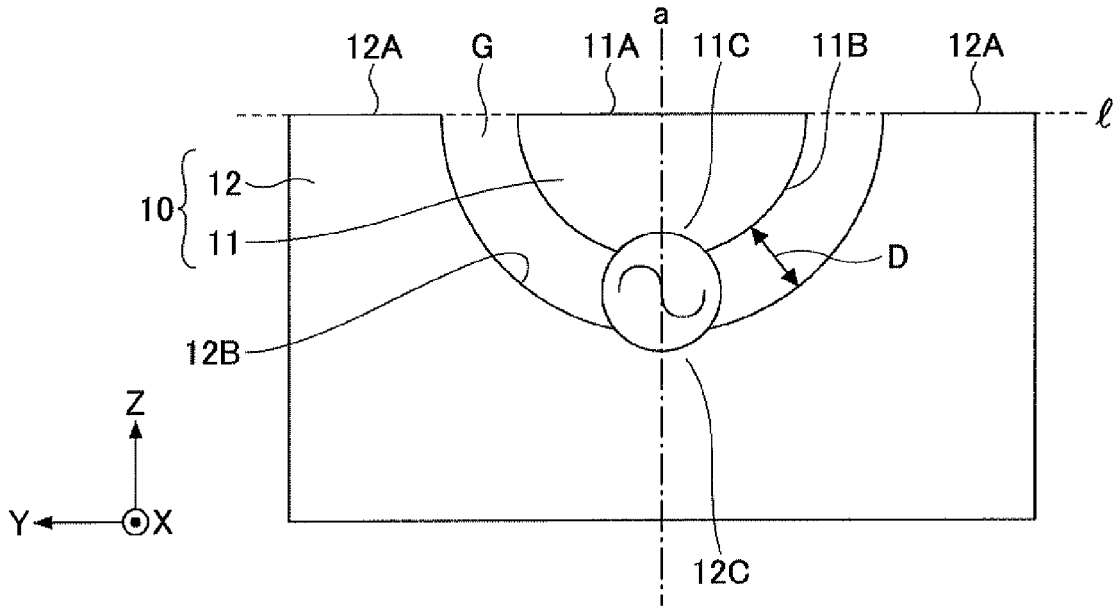
FIG. 1 is a diagram illustrating an antenna device according to a first embodiment of the present invention.

FIG. 1 is a diagram illustrating an antenna device according to a first embodiment of the present invention.

Referring to FIG. 1, an antenna device 10 includes an antenna element 11 and a ground element 12. The antenna element 11 and the ground element 12, which are flat-plate members formed on the same surface of a substrate (not graphically illustrated) such as a glass epoxy FR-4 substrate, are formed of a conductive film of, for example, copper foil.

The antenna element 11, which has a semicircular shape in a plan view, includes a linear (straight) side 11A and a side 11B curved in a semicircle.

The ground element 12, in a plan view, has a rectangular shape having a semicircular cut or indentation on its upper long side so as to have a pair of upper sides 12A and a side 12B curved in a semicircle provided between and connecting the upper sides 12A. That is, the ground element 12 has the shape of a rectangle having a semicircular cut defined by the curved side 12B.

The antenna element 11 and the ground element 12 are placed so that the linear side 11A of the antenna element 11 and the upper sides 12A of the ground element 12 are aligned, that is, positioned on the same straight line l, and that the curved side 11B of the antenna element 11 and the curved side 12B of the ground element 12 are positioned at a fixed or uniform distance (interval) D from each other. That is, the curved sides 11B and 12B face each other across a fixed gap G between them. In other words, the antenna element 11 and the ground element are arranged to form or define a rectangular shape or region in a plan view with the gap G between them.

Thus, the antenna element 11 and the ground element 12 are axially symmetric in shape with respect to an axis of symmetry a of the semicircle of the antenna element 11.

The antenna element 11 has a feeding part 11C near the curved side 11B on the axis of symmetry a. The ground element 12 is grounded at a ground point 12C at a position facing the feeding part 11C across the gap G.

The antenna element 11 may be, for example, 6 mm to 15 mm in diameter, and a distance D between the curved side 11B of the antenna element 11 and the curved side 12B of the ground element 12 may be, for example, approximately 1 mm to approximately 3 mm.

For convenience of graphical representation, the ground element 12 having a rectangular planar shape with a semicircular cut is illustrated in FIG. 1. The shape of the ground element 12, however, is not limited to this. Further, in FIG. 1, the ground element 12 is illustrated that has the upper sides 12A and the curved side 12B, where the upper sides 12A are positioned on the same straight line as the linear side 11A of the antenna element 11. However, this is an example of the shape of the ground element 12, and the upper sides 12A may not be aligned with the linear side 11A. Further, the dimensions of the ground element 12 are not limited in particular.

The x-axis (X), y-axis (Y), and z-axis (Z), which are referred to in the case of describing directivity below, are as illustrated in FIG. 1. The x-axis extends in the directions perpendicular to the plane of the paper, of which the direction coming out of the plane of the paper is a positive direction. The y-axis extends in the right-left (horizontal) directions of the plane of the paper, of which the leftward direction is a positive direction. The z-axis extends in the up-down (vertical) directions of the plane of the paper, of which the upward direction is a positive direction.

Figure 2:
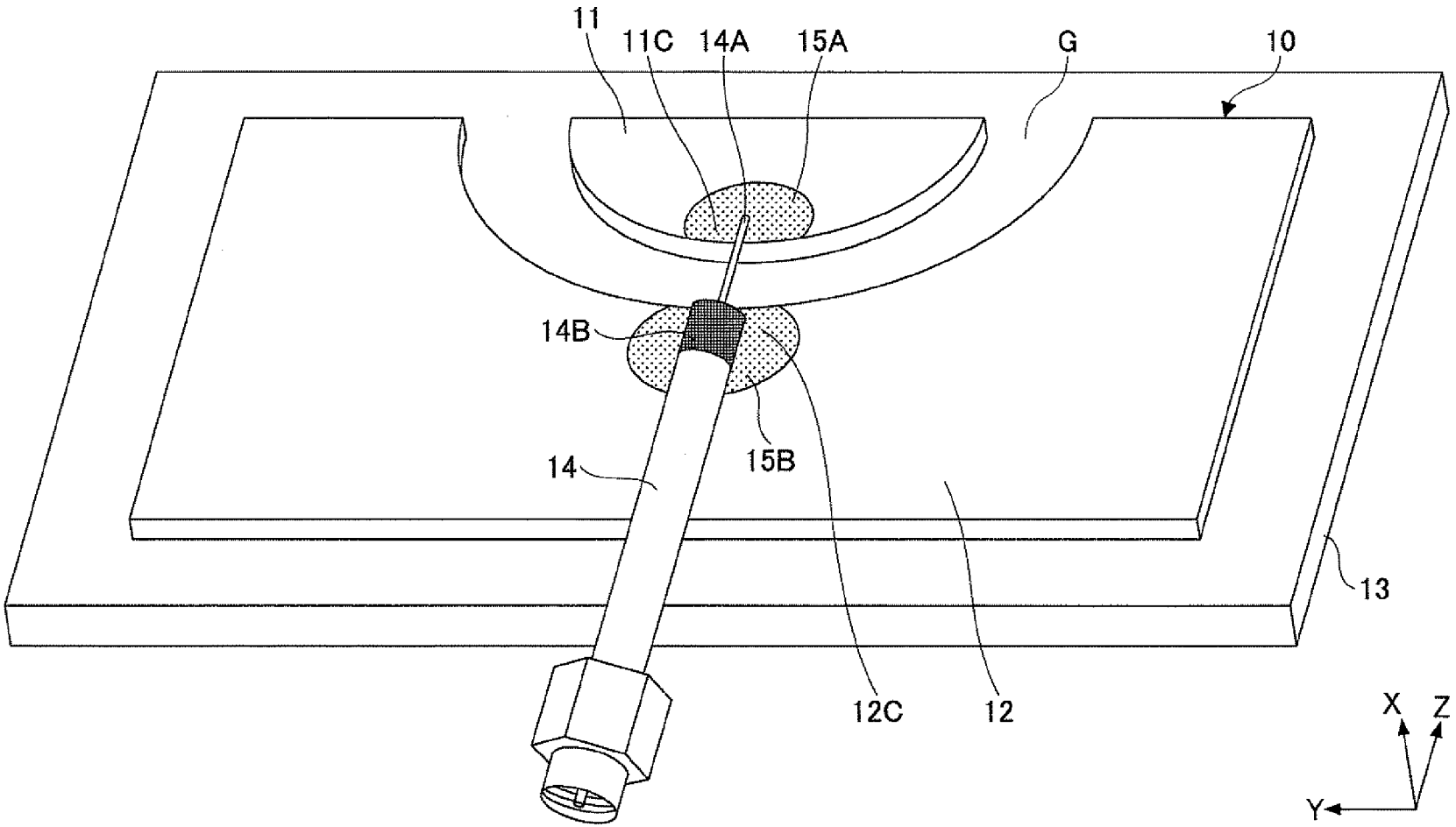
FIG. 2 is a perspective view of the antenna device, to which a coaxial cable is connected, according to the first embodiment of the present invention.

FIG. 2 is a perspective view of the antenna device 10 according to the first embodiment, to which a coaxial cable 14 is connected.

The antenna element 11 and the ground element 12 are formed on the same surface of a substrate 13. Examples of the substrate 13 include a glass epoxy FR-4 substrate.

A core cable 14A of the coaxial cable 14 is connected to the feeding part 11C with, for example, solder 15A. A shield line 14B of the coaxial cable 14 is connected to the ground point 12C of the ground element 12 with, for example, solder 15B. The coaxial cable 14 is connected to an external power supply (not graphically illustrated), and feeds electric power to the antenna device 10. The coaxial cable 14 may have a characteristic impedance of 50Ω, and a high-frequency voltage of, for example, approximately 3.0 GHz to approximately 6.0 GHz is applied to the antenna device 10.

Figure 3:
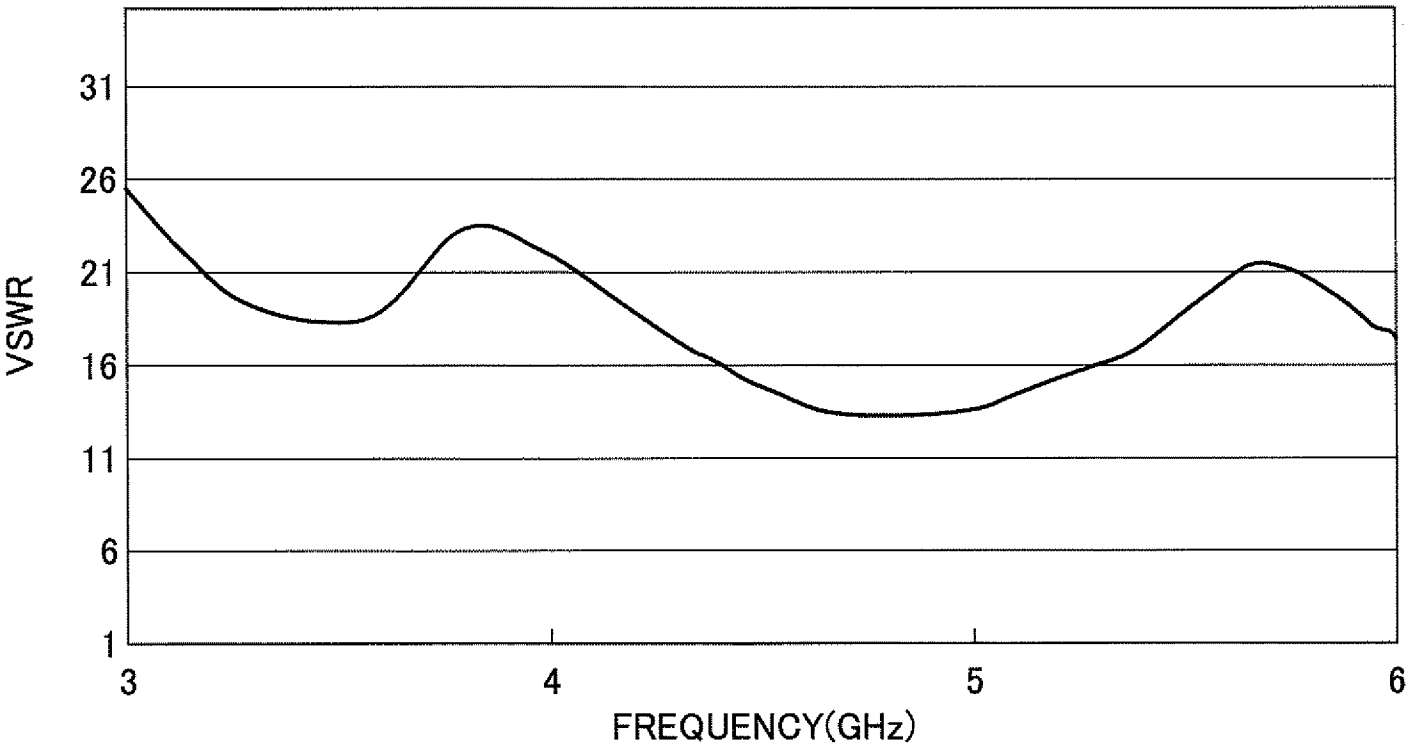
FIG. 3 is a graph illustrating the VSWR characteristic of the antenna device according to the first embodiment of the present invention.

FIG. 3 is a graph illustrating the VSWR (voltage standing wave ratio) characteristic of the antenna device 10.

As illustrated in this VSWR characteristic, it has been found that the antenna device 10 has a value of approximately 13 to approximately 15 between 3.0 GHz and 6.0 GHz. This indicates the presence of many reflections, thus showing that the antenna device 10 is not suitable for long-distance communications.

Figure 4A:
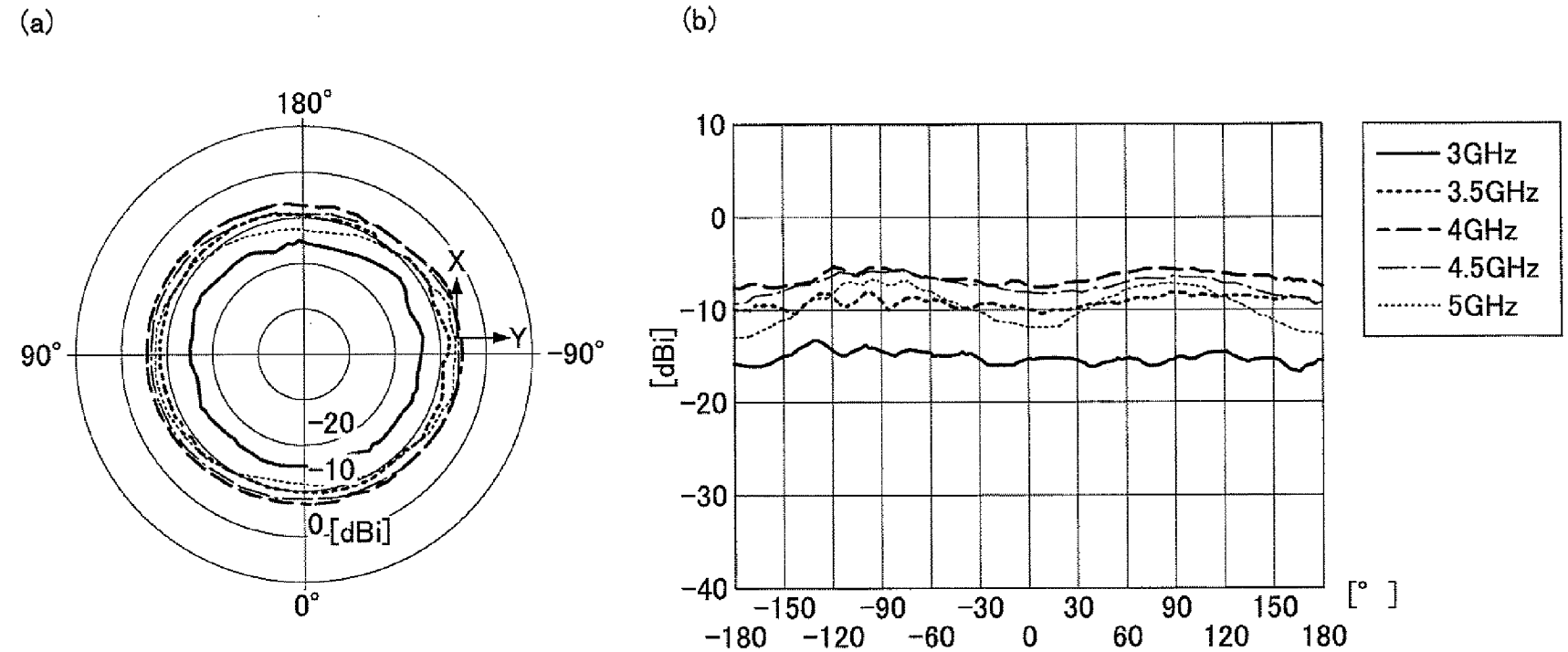
FIGS. 4A and 4B illustrate the directivity of the antenna device according to the first embodiment of the present invention, where
Figure 4B:
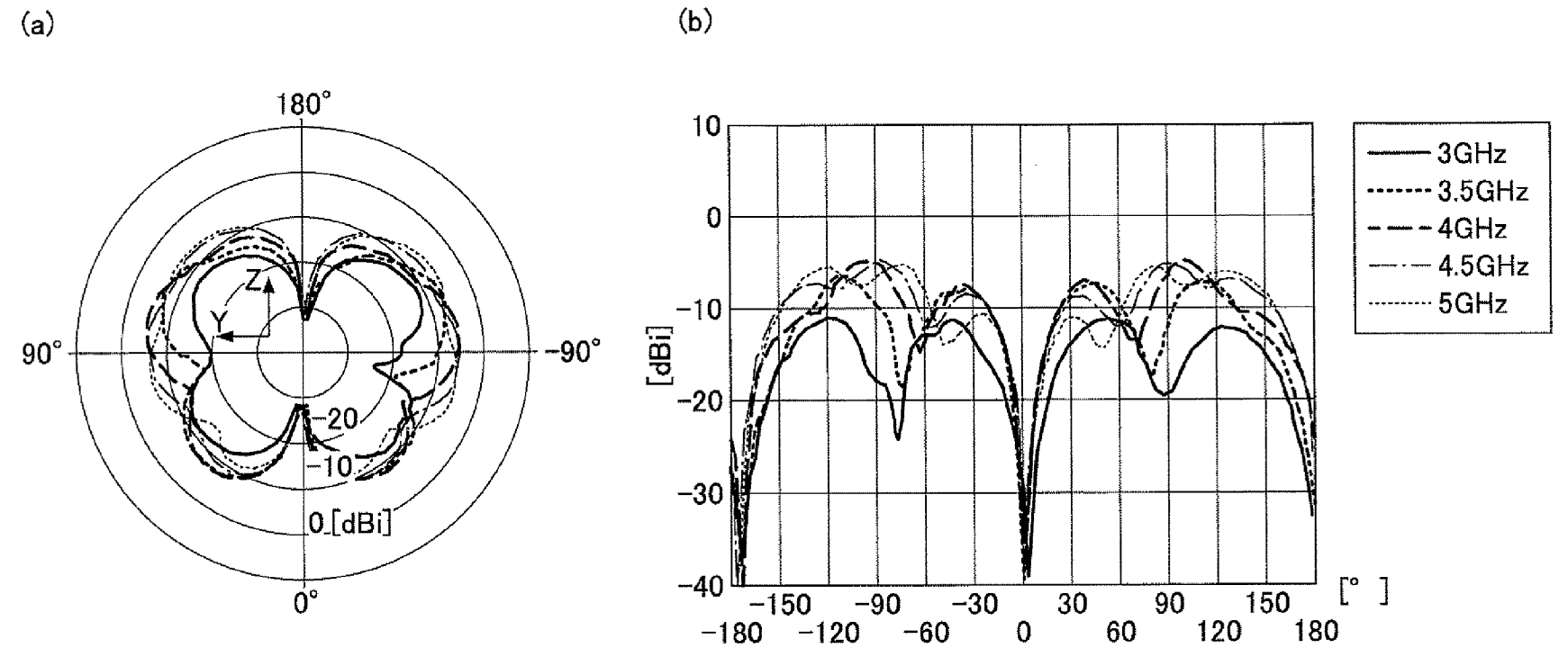

FIGS. 4A and 4B illustrate the directivity of the antenna device 10. FIG. 4A illustrates the angular distribution of the vertical polarization (x-y plane directivity) of the antenna device 10, and FIG. 4B illustrates the angular distribution of the horizontal polarization (y-z plane directivity) of the antenna device 10. The directions of the x-axis, y-axis, and z-axis are as illustrated in FIG. 1.

FIG. 5A is a table illustrating the maximum value (MAX), the average value (AVG), and the minimum value (MIN) of the gain of the vertical polarization of the antenna device 10 by communication frequency. FIG. 5B is a table illustrating the maximum value (MAX), the average value (AVG), and the minimum value (MIN) of the gain of the horizontal polarization of the antenna device 10 by communication frequency. The tables of FIGS. 5A and 5B illustrate the directivity illustrated in FIGS. 4A and 4B in a table format.

As illustrated in FIGS. 4A and 4B, the gain of the antenna device 10 is measured at intervals of 0.5 GHz between 3.0 GHz and 5.0 GHz. As illustrated in FIG. 4A, the gain is as low as approximately −16 dBi to approximately −7 dBi irrespective of the angle. This shows that although the distribution in the x-y plane is substantially uniform, the gain of the antenna device 10 is too low to perform communications in the x-y plane directions.

Further, as shown in the characteristic of the horizontal polarization of FIG. 4B, the gain is approximately −40 dBi, which is a considerably low value, at 0° and 180° and is lower than or equal to approximately −5 dBi at other angles in the y-z plane.

The maximum value (MAX), the average value (AVG), and the minimum value (MIN) of the gain of the vertical polarization thus obtained for each communication frequency are as illustrated in FIG. 5A. Referring to FIG. 5A, the maximum value is lowest at 3.0 GHz and is highest at 4.0 GHz. Further, the average value is lowest at 3.0 GHz and is highest at 4.0 GHz. The minimum value is lowest at 3.0 GHz and is highest at 4.0 GHz.

Further, the maximum value (MAX), the average value (AVG), and the minimum value (MIN) of the gain of the horizontal polarization for each communication frequency are as illustrated in FIG. 5B. Referring to FIG. 5B, the maximum value is lowest at 3.0 GHz and is highest at 4.0 GHz and 4.5 GHz. Further, the average value is lowest at 3.0 GHz and is highest at 4.5 GHz and 5.0 GHz. The minimum value is lowest at 4.0 GHz and is highest at 5.0 GHz.

As illustrated in FIG. 4B, the characteristic of the horizontal (y-z plane) polarization of the antenna device 10 of this embodiment is extremely low at 0° and 180°. Here, the antenna device 10 has a null at the midpoint of the linear side 11A of the antenna element 11 (the point of the linear side 11A on the axis of symmetry of the antenna element 11). The null (null point) is present in the direction of 180°.

Figure 8B:
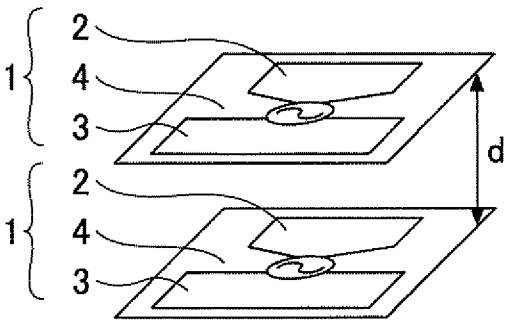
FIGS. 8A and 8B are diagrams illustrating arrangements of the two comparative antenna devices in the case of measuring gain characteristics according to the first embodiment of the present invention.
Figure 8A:
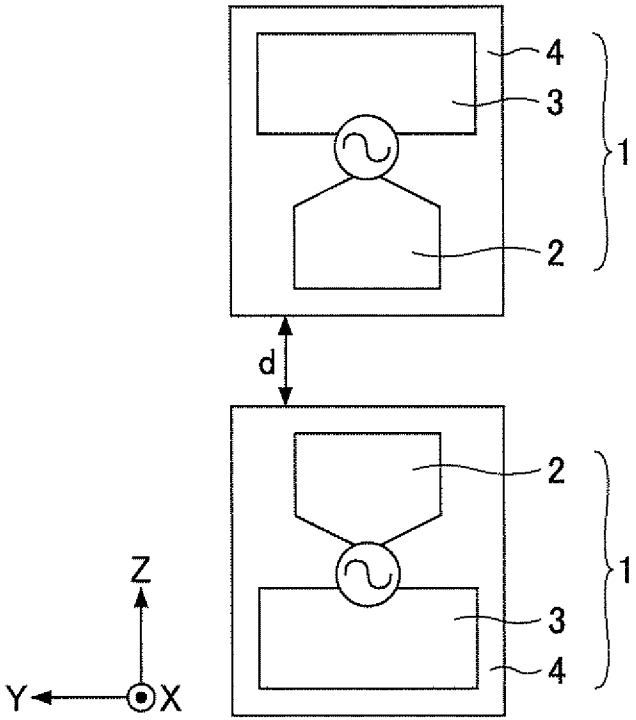

It is believed that short-distance communications are possible if communications are performed in the directions of the nulls of the antenna device 10 (in the z-axis directions illustrated in FIG. 1 and FIG. 2). Accordingly, communications are performed by opposing two antenna devices 10 to each other in the z-axis directions. Further, for comparison, the gain characteristic relative to communication distance is determined in the case of opposing the two antenna devices 10 in the x-axis directions (FIG. 1) and in the case of performing communications in the z-axis directions and the x-axis directions using two antenna devices 1 for comparison purposes (two comparative antenna devices 1) (FIGS. 8A and 8B).

Figure 6:
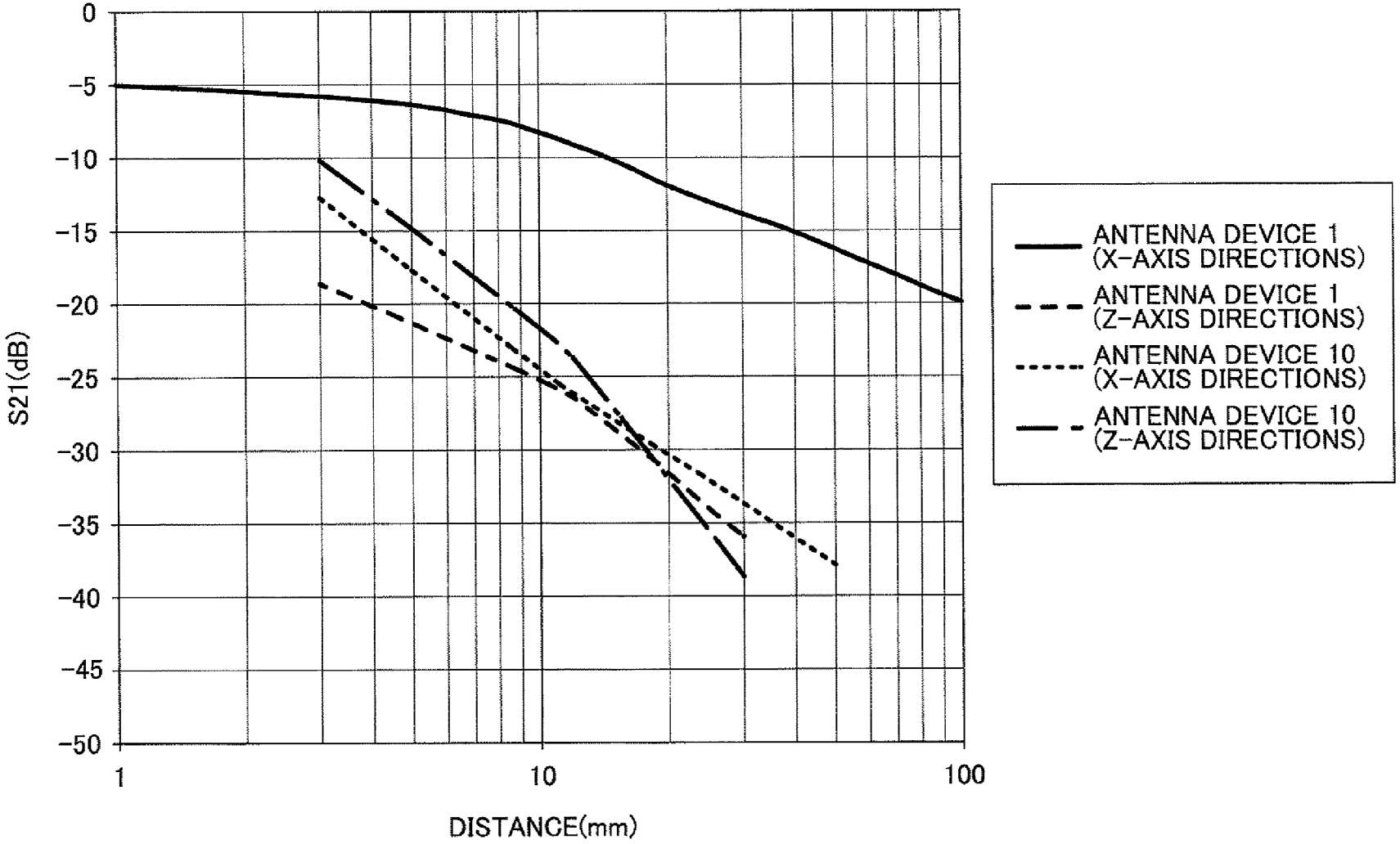
FIG. 6 is a graph illustrating characteristics showing gain relative to distance in the case of performing communications using the two antenna devices of the first embodiment and characteristics showing gain relative to distance in the case of performing communications using two comparative antenna devices.

FIG. 6 is a graph illustrating characteristics showing gain relative to distance ($S_{21}$ of S-parameters) in the case of performing communications using the two antenna devices 10 of this embodiment and characteristics showing gain relative to distance ($S_{21}$ of S-parameters) in the case of performing communications using the two comparative antenna devices 1.

The communication frequency is 4.0 GHz, $\lambda/2\pi$ is approximately 12 mm, and $\lambda/2$ is approximately 40 mm. Therefore, the distance to the boundary between the near field and the far field is believed to be between approximately 12 mm and approximately 40 mm.

FIGS. 7A and 7B and FIGS. 8A and 8B are diagrams illustrating arrangements of two antenna devices in the case of measuring gain characteristics.

Figure 7B:
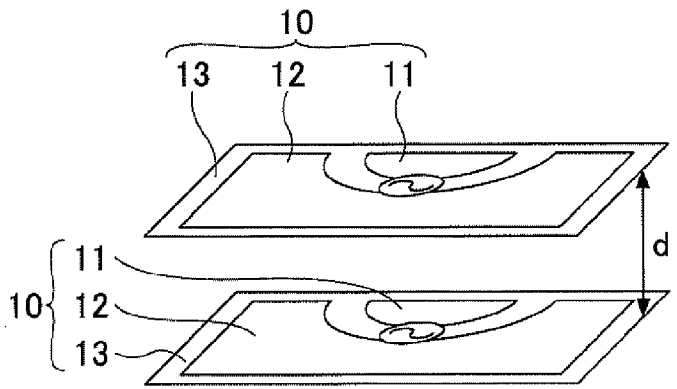
FIGS. 7A and 7B are diagrams illustrating arrangements of the two antenna devices in the case of measuring gain characteristics according to the first embodiment of the present invention.
Figure 7A:
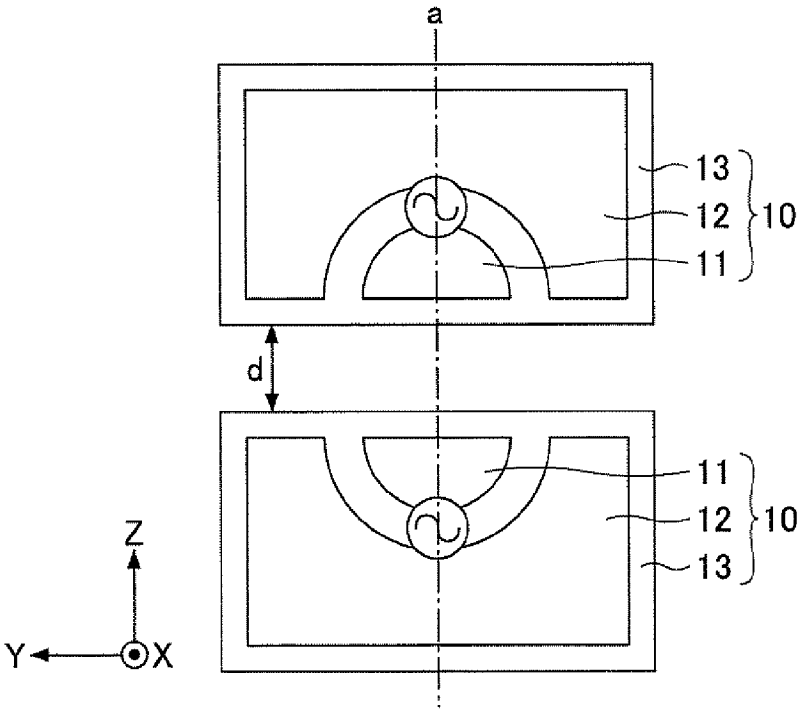

FIG. 7A illustrates the antenna devices 10 of this embodiment arranged in the z-axis directions. FIG. 7B illustrates the antenna devices 10 of this embodiment arranged in the x-axis directions. FIG. 8A illustrates the comparative antenna devices 1 arranged in the z-axis directions. FIG. 8B illustrates the comparative antenna devices 1 arranged in the x-axis directions.

Here, each of the comparative antenna devices 1 has a home plate-shaped antenna element 2 and a rectangular ground element 3 formed on an FR-4 substrate 4. The antenna element 2 and the ground element 3 do not overlap in the z-axis directions. The antenna element 2 has the portion of its vertex, which is the closest to the ground element 3, connected to the core cable of a coaxial cable (not graphically illustrated) to be fed with electric power. The ground element 3 has a portion near the feeding part of the antenna element 2 connected to the shield line of the coaxial cable.

The comparative antenna devices 1 are UWB (ultra wideband) antenna devices having extremely uniform and good directivity with a VSWR of approximately 2.0 to approximately 3.0 over 3.0 GHz to 10.0 GHz.

As illustrated in FIG. 6, in the case of opposing the two comparative antenna devices 1 to each other in a close range across a distance d in the x-axis directions (FIG. 8B), the $S_{21}$ parameter is approximately −5 dB in the case of d=1.0 mm, approximately −8 dB in the case of d=10.0 mm, and approximately −20 dB in the case of d=100.0 mm. Thus, good values with little loss are obtained. This shows that the comparative antenna device 1 can perform high-quality communications in both the near field and the far field in the x-axis directions.

Next, in the case of opposing the two comparative antenna devices 1 to each other in a close range across a distance d in the z-axis directions (FIG. 8A), the $S_{21}$ parameter is approximately −18 dB in the case of d=3.0 mm, approximately −25 dB in the case of d=10.0 mm, and approximately −36 dB in the case of d=30.0 mm. Thus, values with relatively large loss are obtained. This shows that communications are difficult with the comparative antenna device 1 in both the near field and the far field in the z-axis directions.

On the other hand, in the case of opposing the two antenna devices 10 of this embodiment to each other in a close range across a distance d in the z-axis directions (FIG. 7A), the $S_{21}$ parameter is approximately −10 dB in the case of d=3.0 mm, approximately −22 dB in the case of d=10.0 mm, and approximately −38 dB in the case of d=30.0 mm. This shows that the antenna device 10 of this embodiment is suitable for near-field communications because the obtained values are better with smaller loss than those of the comparative antenna device 1 in the near field in the z-axis directions. On the other hand, this shows that communications are difficult with the antenna device 10 in the far field because the loss of the antenna device 10 is greater than the loss of the comparative antenna device 1 in the far field in the z-axis directions.

Further, in the case of opposing the two antenna devices 10 of this embodiment to each other in a close range across a distance d in the x-axis directions (FIG. 7B), the $S_{21}$ parameter is approximately −13 dB in the case of d=3.0 mm, approximately −24 dB in the case of d=10.0 mm, approximately −33 dB in the case of d=30.0 mm, and approximately −36 dB in the case of d=40.0 mm. This shows that the loss in the x-axis directions is greater in the antenna device 10 of this embodiment than in the comparative antenna device 1 and that communications are difficult with the antenna device 10 in the x-axis directions.

Thus, it has been found that the loss of the antenna device 10 of this embodiment is smaller in the near field in the z-axis directions and greater in the x-axis directions than the loss of the comparative antenna device 1. It is believed that this difference in characteristic is caused by formation of the ground element 12 up to substantially the same (vertical) position as the antenna element 11 in the z-axis directions.

Thus, according to the first embodiment, it is possible to provide the antenna device 10 for low-power communications suitable for short-distance communications by using the direction of 180° in directivity (a z-axis direction where a null is present) as the direction of communications. Here, the antenna device 10 of this embodiment includes the ground element 12, which is formed (to extend) in a null direction (a direction where a null is present) up to a vertical position level with the null in the y-z plane of FIG. 1. Therefore, there is very little radiation of radio waves from the antenna device 10 of this embodiment in the z-axis directions and in the x-y plane directions.

This makes it possible to perform short-distance communications in a z-axis direction where a null is present.

Further, the communication distance may be less than or equal to approximately 10 cm, for example. Because of such a short communication distance, the effect that communications are less susceptible to disturbance is produced.

Figure 9:
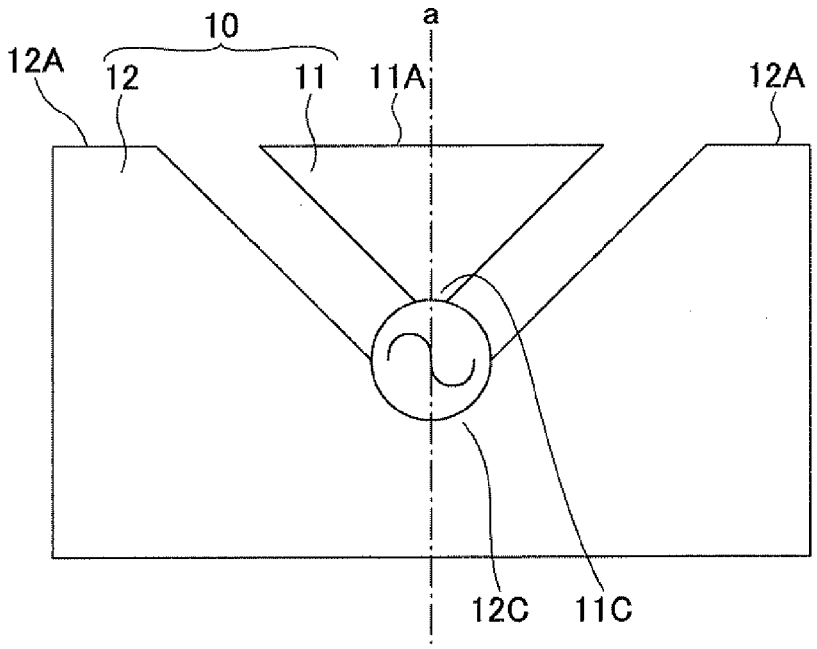
FIG. 9 is a diagram illustrating a variation of the antenna device according to the first embodiment of the present invention.

In the above, a description is given of the configuration where the antenna element 11 of the antenna device 10 has a semicircular shape and the ground element 12 of the antenna device 10 has a rectangular shape with a semicircular cut. Alternatively, the antenna element 11 may have a shape of an isosceles triangle as illustrated in FIG. 9, which illustrates a variation of the antenna device 10. In this case, the ground element 12 may be formed by cutting out an isosceles triangle portion from the side of its upper sides 12A so that the distance to the antenna element 11 having an isosceles triangle shape is uniform.

Figure 10:
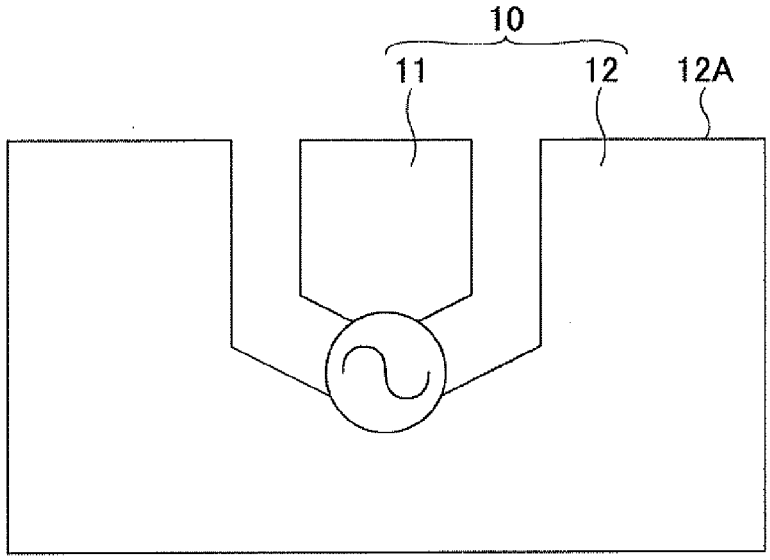
FIG. 10 is a diagram illustrating another variation of the antenna device according to the first embodiment of the present invention.

Likewise, the antenna element 11 may have a polygonal shape. For example, as illustrated in FIG. 10, the antenna element 11 may have a home-plate shape, which is a form of polygon. In this case, the ground element 12 may be formed to have a home-plate-shaped cut formed from the side of its upper sides 12A so that the distance to the antenna element 11 having a home-plate shape is uniform.

In the first embodiment, a description is given of the antenna device 10 including the antenna element 11 and the ground element 12 that are axially symmetric in shape with respect to an axis of symmetry. However, the antenna element 11 and the ground element 12 may not be axially symmetric in shape. For example, the antenna element 11 and the ground element 12 may not be axially symmetric in a technical sense, and may be configured asymmetrically for directivity adjustment.

[b] Second Embodiment

Figure 11B:
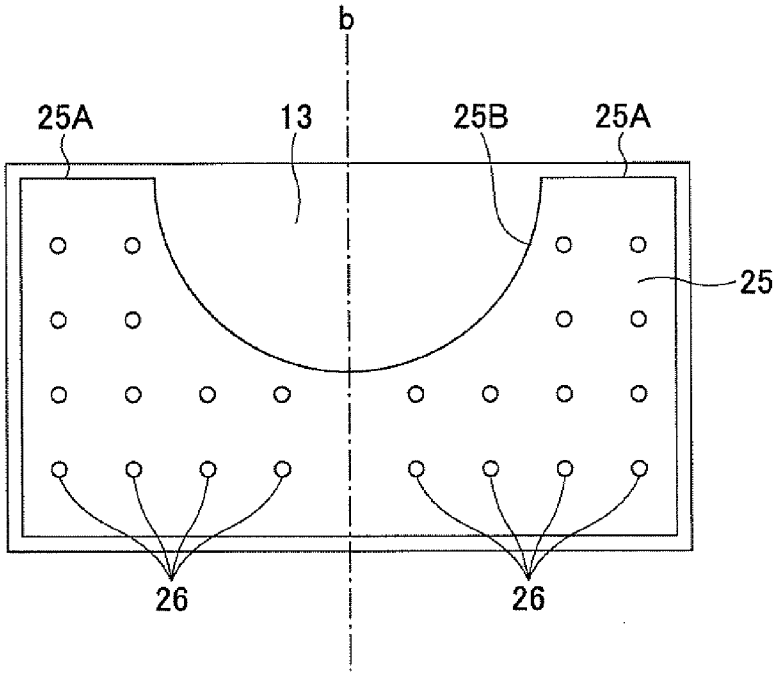
FIGS. 11A and 11B are diagrams illustrating an antenna device according to a second embodiment of the present invention, where
Figure 11A:
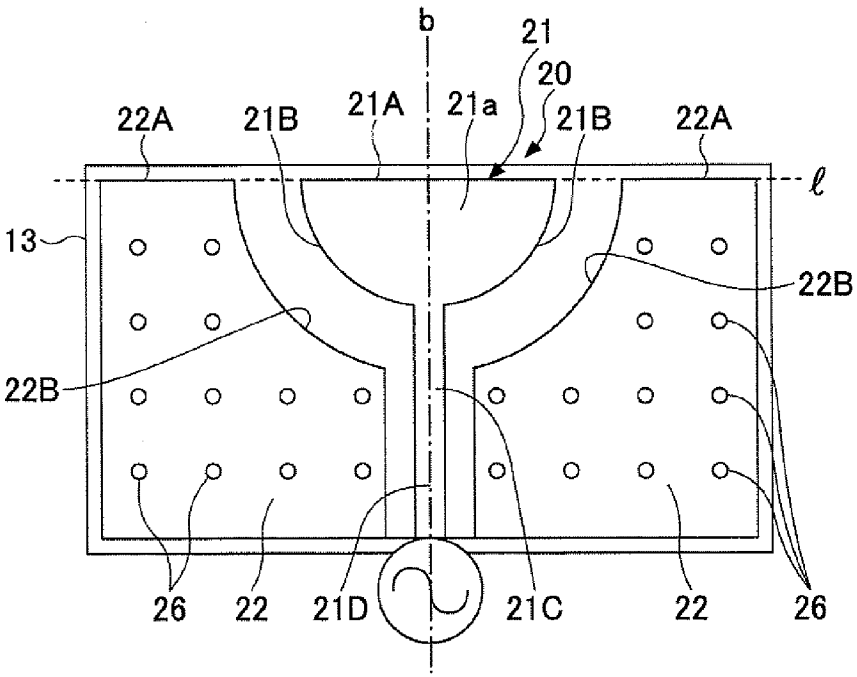

FIGS. 11A and 11B are diagrams illustrating an antenna device 20 according to a second embodiment of the present invention. FIG. 11A is a top plan view of the antenna device 20, and FIG. 11B is a bottom plan view of the antenna device 20.

The antenna device 20 of the second embodiment is different from the antenna device 10 of the first embodiment (FIG. 1) in including a microstrip line or a coplanar waveguide.

Referring to FIG. 11A, the antenna device 20 includes an antenna element 21 and a ground element 22. The antenna element 21 includes a body part 21*a* and a microstrip line 21C. The body part 21*a* is defined by a linear (straight) side 21A and a side 21B curved in a semicircle, and the microstrip line 21C extends on an axis of symmetry b from the curved side 21B.

The ground element 22 includes a pair of upper sides 22A and a pair of sides 22B curved in an arc. The ground element 22 is divided by the microstrip line 21C into two portions: one on one side of the axis of symmetry b and the other on the other side of the axis of symmetry b.

Referring to FIG. 11B, the antenna device 20 further includes a ground element 25 on its bottom side, which is opposite to the top side illustrated in FIG. 11A. The ground element 25 is successively formed on the bottom surface of the substrate 13, which is opposite to the top surface on which the ground element 22 and the antenna element 21 including the microstrip line 21C are formed. The ground element 25 has a rectangular shape with a semicircular cut formed on one of its long sides.

The ground element 25 includes a pair of upper sides 25A and a side 25B curved in a semicircle. In a transparent plan view, the upper sides 25A and the curved side 25B are superposed on the upper sides 22A and the curved sides 22B, respectively, of the ground element 22 on the top side. That is, the ground element 25 has the same shape as the ground element 12 (FIG. 1) of the antenna device 10 of the first embodiment. Thus, in a plan view, the antenna element 21 and the ground element 25 are arranged to form or define a rectangular shape or region with a gap between them.

The ground element 22 on the top side and the ground element 25 on the bottom side are connected via multiple via holes 26.

The microstrip line 21C has its end (lower end in FIG. 11A) serving as a feeding point 21D, to which the core cable 14A of the coaxial cable 14 (FIG. 2) is connected. The shield line 14B of the coaxial cable 14 is connected to the ground element 22 on the top side.

Theoretically, no loss is caused in the microstrip line 21C, whose characteristic impedance is set at 50Ω.

Therefore, the antenna device 20 of the second embodiment has the same characteristics as the antenna device 10 of the first embodiment.

That is, according to the second embodiment, it is possible to provide the antenna device 20 for low-power communications suitable for short-distance communications by using the direction of 180° in directivity as the direction of communications. The communication distance may be less than or equal to approximately 10 cm, for example. Because of such a short communication distance, the effect that communications are less susceptible to disturbance is produced.

Figure 12B:
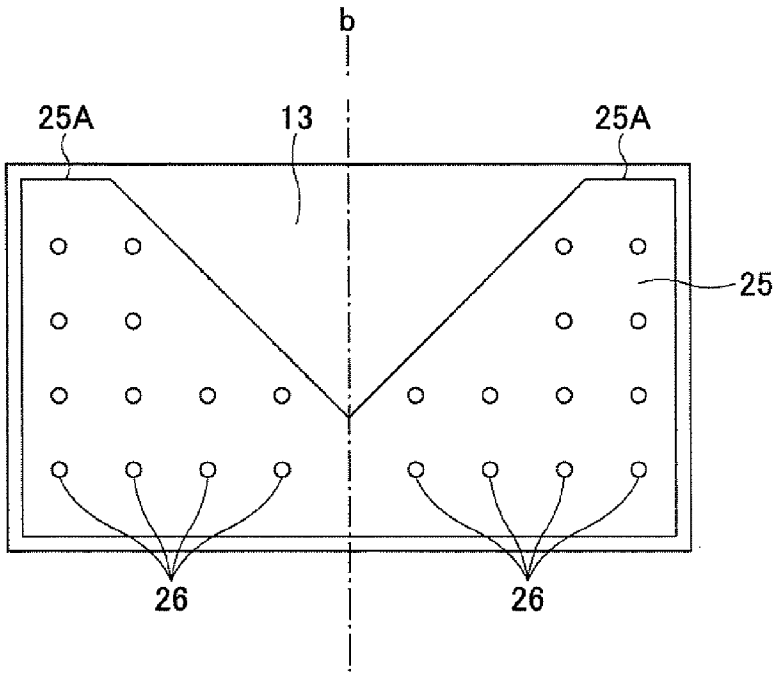
FIGS. 12A and 12B are diagrams illustrating a variation of the antenna device according to the second embodiment of the present invention, where
Figure 12A:
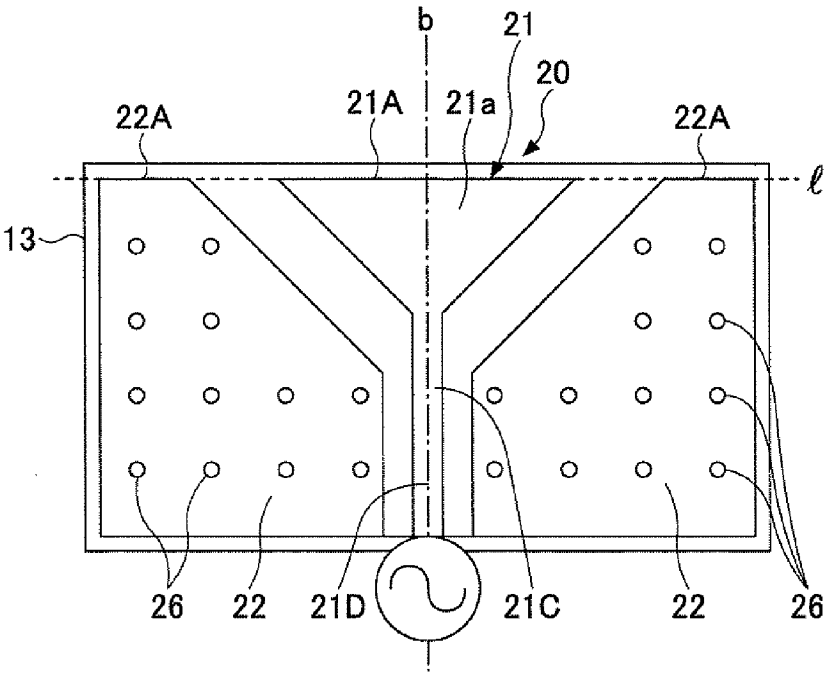

In the above, a description is given of the configuration where the antenna element 21 of the antenna device 20 has the shape of a semicircle with the microstrip line 21C connected thereto and the ground element 22 of the antenna device 20 has the shape of a rectangle with a semicircular cut divided into two portions by the microstrip line 21C. Alternatively, the antenna element 21 may also have the shape of an isosceles triangle with the microstrip line 21C connected thereto as illustrated in FIG. 12A, and the ground element 22 may also have the shape of a rectangle, from which an isosceles triangle portion is cut off from the side of the upper sides 22A, divided into two portions by the microstrip line 21C. In this case, the ground element 22 may be formed so that the distance to the body part 21*a* of an isosceles triangle shape of the antenna element 21 is uniform. Further, as illustrated in FIG. 12B, the ground element 25 on the bottom side may have a rectangular shape with an isosceles triangle cut on one of its long sides.

FIG. 12A illustrates the case where the shape of the body part 21*a* to which the microstrip line 21C is connected is an isosceles triangle. However, the shape of the body part 21*a* is not limited to this, and may be an axially symmetric polygon such as a home-plate shape. In this case, the ground element 25 on the bottom side may also have a polygonal cut.

In the above, a description is given of the case where the antenna element 21 includes the microstrip line 21C. However, a coplanar waveguide 21E may be formed as illustrated in FIG. 13 if the ground element 25 on the bottom side is not included.

Figure 13:
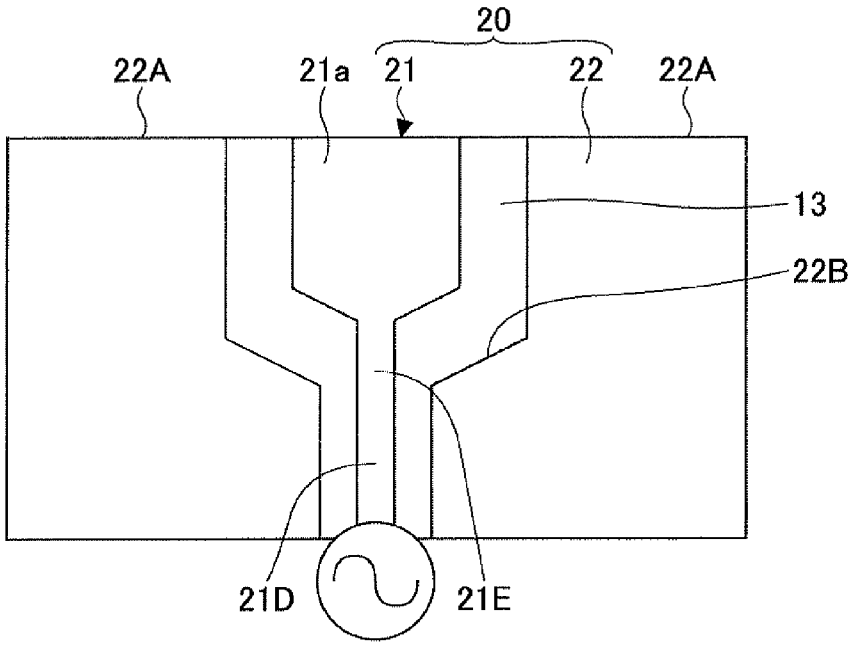
FIG. 13 is a diagram illustrating another variation of the antenna device according to the second embodiment of the present invention.

In the antenna element 21 illustrated in FIG. 13, the coplanar waveguide 21E is connected to the body part 21*a* having a home-plate shape, which is a form of polygon. The ground element 22 has the shape of a rectangle, from which a home-plate-shaped portion is cut off from the side of the upper sides 22A, divided by the coplanar waveguide 21E. In this case, the ground element 22 may be formed so as to have a uniform distance between the home-plate-shaped body part 21*a* of the antenna element 21 and the ground element 22.

FIG. 13 illustrates the case where the body part 21*a* to which the coplanar waveguide 21E is connected has a home-plate shape, which is a form of polygon. However, the shape of the body part 21*a* of the antenna element 21 is not limited to this, and may be other polygonal shapes such as an isosceles triangle shape as long as the shapes are axially symmetric.

Further, in the second embodiment, a description is given of the antenna device 20 having the ground element 22 formed on the top side and the ground element 25 formed on the bottom side. Alternatively, the antenna device 20 may have the ground element 25 on the bottom side without forming the ground element 22 on the top side.

[c] Third Embodiment

Figure 14:
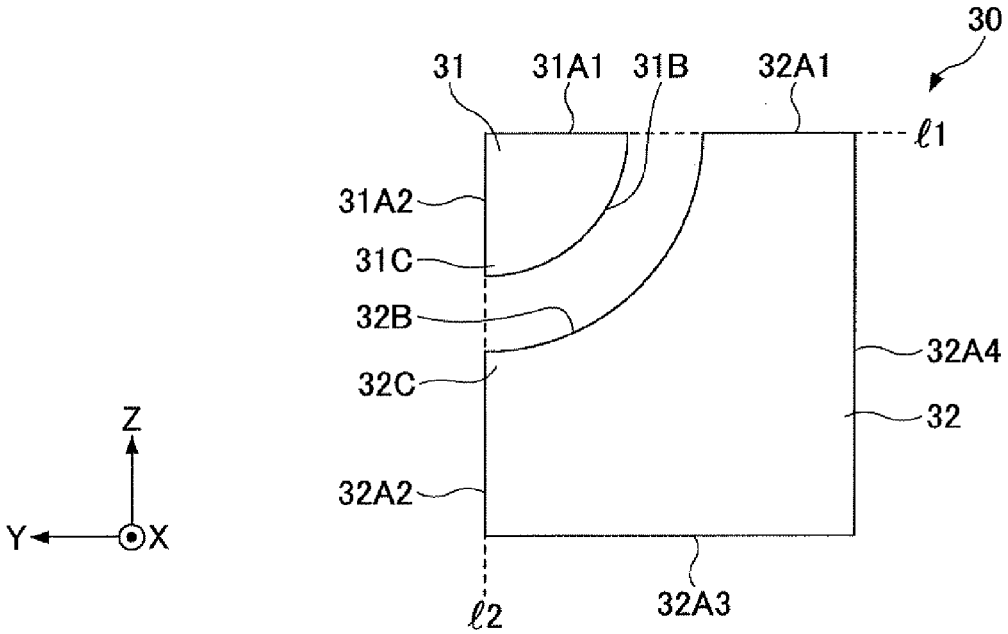
FIG. 14 is a diagram illustrating an antenna device according to a third embodiment of the present invention.

FIG. 14 is a diagram illustrating an antenna device 30 according to a third embodiment of the present invention.

The antenna device 30 of this embodiment includes an antenna element having the shape of a quarter of a circle, or a quarter circle, which is a variation of the semicircular antenna element 11 of the antenna device 10 of the first embodiment.

Referring to FIG. 14, the antenna device 30 includes an antenna element 31 having a quarter circle shape and a ground element 32 having the shape of a square from a corner of which a quarter circle is cut off.

The antenna element 31 includes linear (straight) sides 31A1 and 31A2, a side 31B curved in an arc, and a feeding point 31C. The linear sides 31A1 and 31A2 correspond to radii of a circle including the quarter circle of the antenna element 31, and the curved side 31B corresponds to a quarter of the circumference of the circle. The feeding point 31C is positioned near the intersection point of the linear side 31A2 and the curved side 31B.

The ground element 32 includes linear (straight) sides 32A1, 32A2, 32A3, and 32A4, a side 32B curved in an arc, and a ground point 32C. The linear sides 32A1 and 32A2 are positioned on the same straight lines 11 and 12 as the linear sides 31A1 and 31A2, respectively, of the antenna element 31. The linear sides 32A3 and 32A4 correspond to two sides of a square. The curved line 32B corresponds to a quarter of a circumference. The ground point 32C is positioned near the intersection point of the linear side 32A2 and the curved side 32B.

The antenna element 31 and the ground element 32 are on the same surface of a substrate such as a glass epoxy FR-4 substrate (not graphically illustrated).

Here, the sides 31A1 and 31A2 of the antenna element 31 may be, for example, 6 mm to 15 mm in length. The distance between the curved side 31B of the antenna element 31 and the curved side 32B of the ground element 32 may be, for example, approximately 1 mm to approximately 3 mm. For convenience of description, the ground element 32 is illustrated as a square with a semicircular cut in FIG. 14, but the basic planar shape of the ground element 32 is not limited to a square.

Further, the feeding point 31C and the ground point 32C may be moved to any positions along the curved sides 31B and 32B, respectively. By adjusting the positions of the feeding point 31C and the ground point 32C, it is possible to adjust the VSWR characteristic in particular.

The x-axis (X), y-axis (Y), and z-axis (Z), which are referred to in the case of describing directivity below, are as illustrated in FIG. 14. The x-axis extends in the directions perpendicular to the plane of the paper, of which the direction coming out of the plane of the paper is a positive direction. The y-axis extends in the right-left (horizontal) directions of the plane of the paper, of which the leftward direction is a positive direction. The z-axis extends in the up-down (vertical) directions of the plane of the paper, of which the upward direction is a positive direction.

Figure 15A:
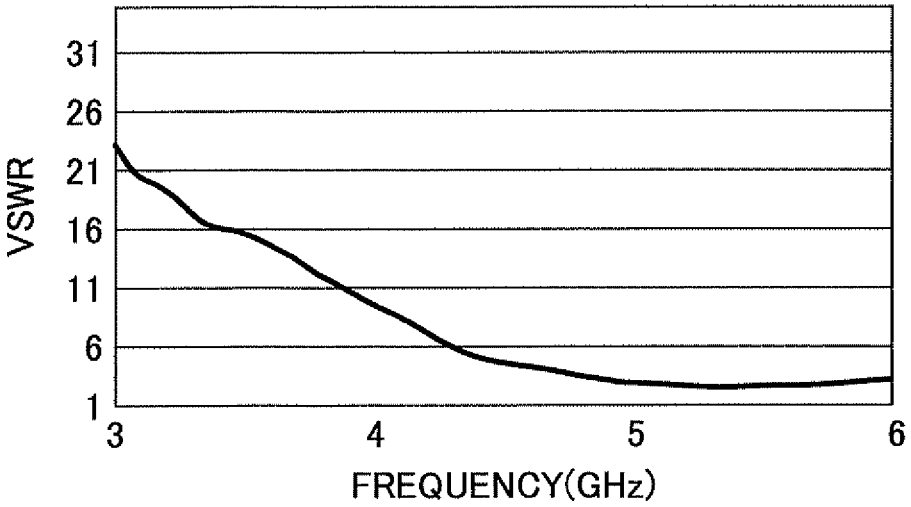
FIGS. 15A through 15C are graphs illustrating the VSWR characteristic and the directivity of the antenna device according to the third embodiment of the present invention.
Figure 15B:
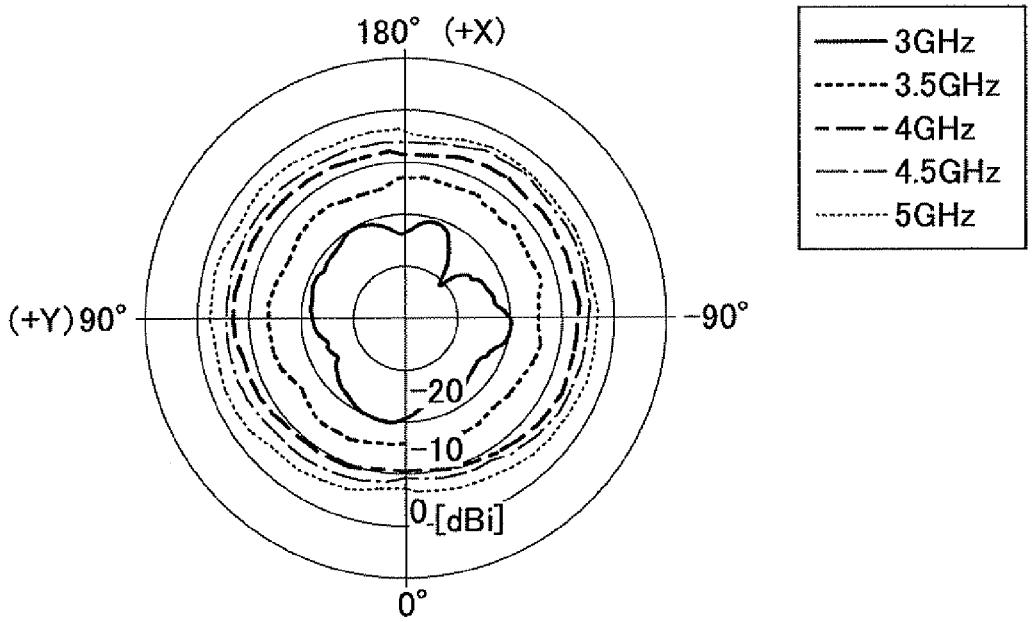
Figure 15C:
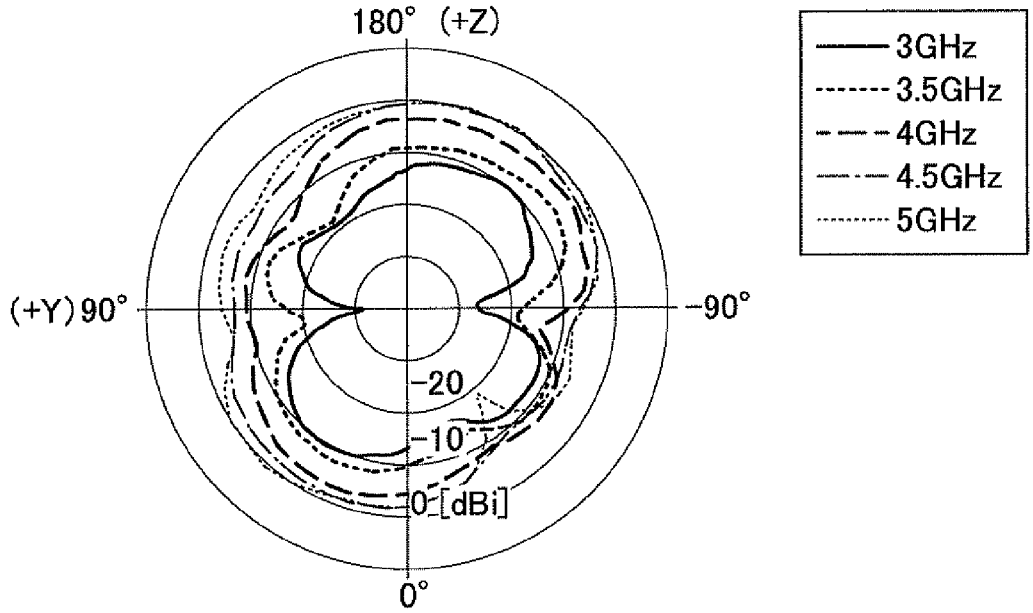

FIGS. 15A, 15B, and 15C are graphs illustrating the VSWR characteristic and the directivity of the antenna device 30 of this embodiment. FIG. 15A illustrates the VSWR characteristic of the antenna device 30. FIGS. 15B and 15C illustrate the angular distribution of the vertical polarization (x-y plane directivity) and the angular distribution of the horizontal polarization (y-z plane directivity), respectively, of the antenna device 30 measured according to a 3 m method. The directions of the x-axis, y-axis, and z-axis are as illustrated in FIG. 14.

As illustrated in the VSWR characteristic of FIG. 15A, it has been found that the antenna device 30 has a value of approximately 10 to approximately 20 between 3.0 GHz and 4.0 GHz. This indicates the presence of many reflections, thus showing that the antenna device 30 is not suitable for long-distance communications.

With respect to the directivity, the gain of the antenna device 30 is measured at intervals of 0.5 GHz between 3.0 GHz and 5.0 GHz. As illustrated in FIG. 15B, the gain is as low as less than or equal to approximately −3 dBi irrespective of the angle. This shows that although the distribution in the x-y plane is substantially uniform, the gain of the antenna device 30 is too low to perform communications in the x-y plane directions.

Further, as illustrated in FIG. 15C, the gain is approximately −2 dBi, which is a considerably low value, at 0° and 180°, which are directions close to null directions is present in the y-z plane.

Thus, according to the third embodiment, it is possible to provide the antenna device 30 for low-power communications suitable for short-distance communications by using the direction of 180° in directivity (a z-axis direction close to a null direction) as the direction of communications. Here, the antenna device 30 of this embodiment includes the ground element 32, which is formed (to extend) in a direction close to a null direction up to a vertical position level with the null in the y-z plane of FIG. 14. Therefore, there is very little radiation of radio waves from the antenna device 30 of this embodiment in the z-axis directions and in the x-y plane directions.

This makes it possible to perform short-distance communications in a z-axis direction close to a null.

Further, the communication distance may be less than or equal to approximately 10 cm, for example. Because of such a short communication distance, the effect that communications are less susceptible to disturbance is produced.

[d] Fourth Embodiment

Figure 16:
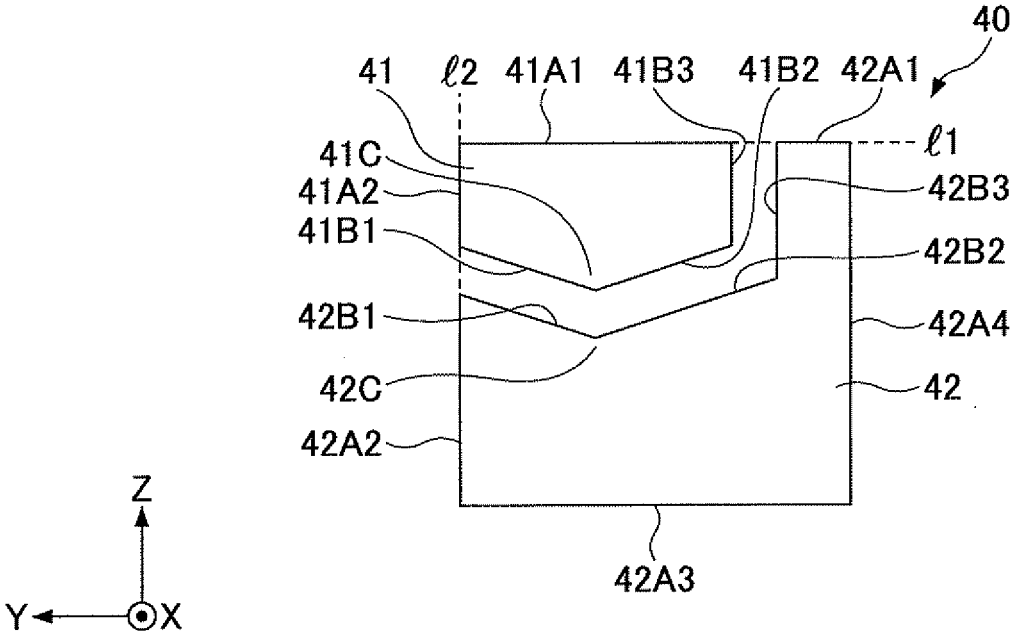
FIG. 16 is a diagram illustrating an antenna device according to a fourth embodiment of the present invention.

FIG. 16 is a diagram illustrating an antenna device 40 according to a fourth embodiment of the present invention.

The antenna device 40 of this embodiment includes an antenna element having a home-plate shape, which is a variation of the quarter-circle-shaped antenna element 31 of the antenna device 30 of the third embodiment.

The antenna device 40 has an antenna element 41 having a home-plate shape and a ground element 42 having the shape of a square from which a home-plate-shaped portion (corresponding to the antenna element 41) is cut off.

The antenna element 41 includes linear sides 41A1 and 41A2, linear sides 41B1, 41B2, and 41B3, and a feeding point 41C. The feeding point 41C is positioned near the intersection point of the side 41B1 and the side 41B2.

The ground element 42 includes linear sides 42A1, 42A2, 42A3, and 42A4, sides 42B1, 42B2, and 42B3, and a ground point 42C. The linear sides 42A1 and 42A2 are positioned on the same straight lines 11 and 12 as the liner sides 41A1 and 41A2, respectively, of the antenna element 41. The linear sides 42A3 and 42A4 correspond to two sides of a square. The sides 42B1 through 42B3 face (are opposed to) the sides 41B1 through 41B3, respectively, of the antenna element 41. The ground point 42C is positioned near the intersection point of the side 42B1 and the side 42B2.

The antenna element 41 and the ground element 42 are formed on the same surface of a substrate such as a glass epoxy FR-4 substrate (not graphically illustrated).

Here, the linear side 41A1 of the antenna element 41 may be, for example, 10 mm to 25 mm in length, and the linear side 41A2 of the antenna element 41 may be, for example, 6 mm to 15 mm in length. Further, the distance between the sides 41B1 through 41B3 of the antenna element 41 and the sides 42B1 through 42B3 of the ground element 42 may be, for example, approximately 1 mm to approximately 3 mm. For convenience of description, the ground element 42 is illustrated as a square with a home-plate-shaped cut in FIG. 16, but the basic planar shape of the ground element 42 is not limited to a square.

Further, the feeding point 41C and the ground point 42C may be moved to any positions along the curved sides 41B1 through 41B3 and 42B1 through 42B3, respectively. By adjusting the positions of the feeding point 41C and the ground point 42C, it is possible to adjust the VSWR characteristic in particular.

The x-axis (X), y-axis (Y), and z-axis (Z), which are referred to in the case of describing directivity below, are as illustrated in FIG. 16. The x-axis extends in the directions perpendicular to the plane of the paper, of which the direction coming out of the plane of the paper is a positive direction. The y-axis extends in the right-left (horizontal) directions of the plane of the paper, of which the leftward direction is a positive direction. The z-axis extends in the up-down (vertical) directions of the plane of the paper, of which the upward direction is a positive direction.

Figure 17A:
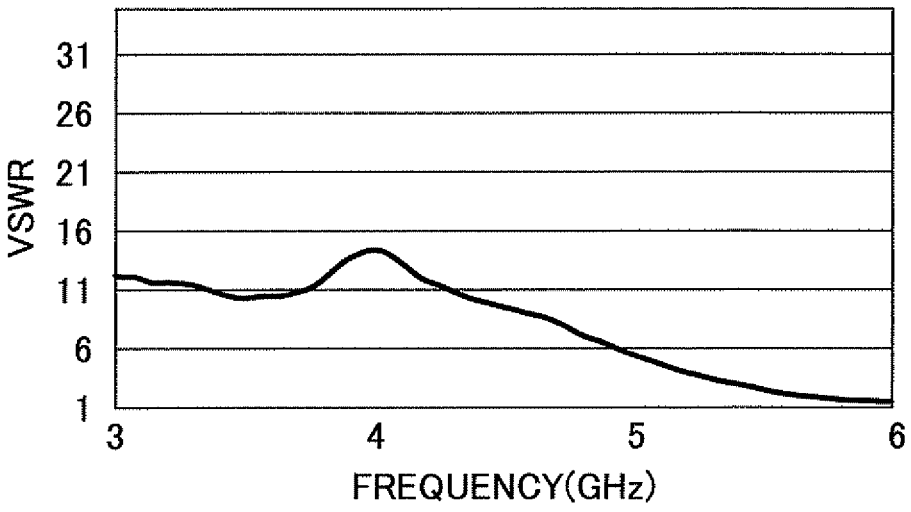
FIGS. 17A through 17C are graphs illustrating the VSWR characteristic and the directivity of the antenna device according to the fourth embodiment of the present invention.
Figure 17B:
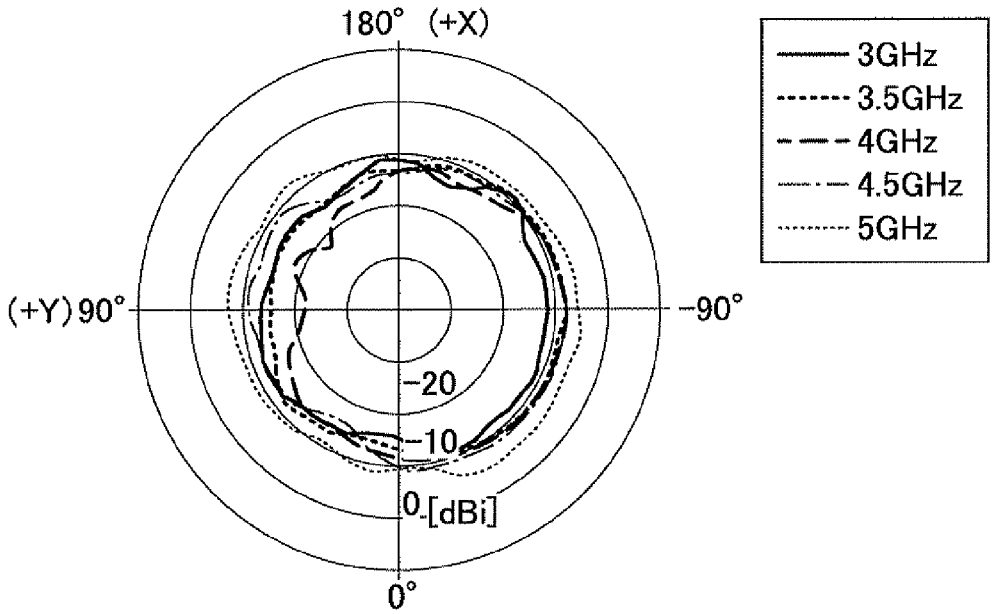
Figure 17C:
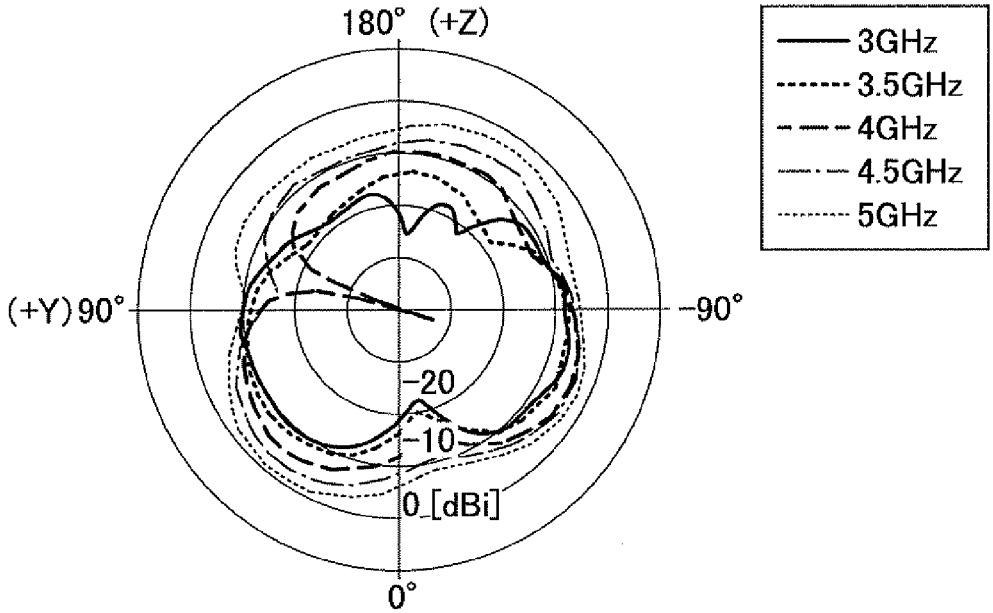

FIGS. 17A, 17B, and 17C are graphs illustrating the VSWR characteristic and the directivity of the antenna device 40 of this embodiment. FIG. 17A illustrates the VSWR characteristic of the antenna device 40. FIGS. 17B and 17C illustrate the angular distribution of the vertical polarization (x-y plane directivity) and the angular distribution of the horizontal polarization (y-z plane directivity), respectively, of the antenna device 40 measured according to a 3 m method. The directions of the x-axis, y-axis, and z-axis are as illustrated in FIG. 16.

As illustrated in the VSWR characteristic of FIG. 17A, it has been found that the antenna device 40 has a value of approximately 10 to approximately 15 between 3.0 GHz and 4.0 GHz. This indicates the presence of many reflections, thus showing that the antenna device 40 is not suitable for long-distance communications.

With respect the directivity, the gain of the antenna device 40 is measured at intervals of 0.5 GHz between 3.0 GHz and 5.0 GHz. As illustrated in FIG. 17B, the gain is as low as less than or equal to approximately −16 dBi irrespective of the angle. This shows that although the distribution in the x-y plane is substantially uniform, the gain of the antenna device 40 is too low to perform communications in the x-y plane directions.

Further, as illustrated in FIG. 17C, the gain is approximately −6 dBi, which is a considerably low value, at 0° and 180°, which are directions close to null directions in the y-z plane.

Thus, according to the fourth embodiment, it is possible to provide the antenna device 40 for low-power communications suitable for short-distance communications by using the direction of 180° in directivity (a z-axis direction close to a null direction) as the direction of communications. Here, the antenna device 40 of this embodiment includes the ground element 42, which is formed (to extend) in a direction close to a null direction up to a vertical position level with the null in the y-z plane of FIG. 16. Therefore, there is very little radiation of radio waves from the antenna device 40 of this embodiment in the z-axis directions and in the x-y plane directions.

This makes it possible to perform short-distance communications in a z-axis direction close to a null.

Further, the communication distance may be less than or equal to approximately 10 cm, for example. Because of such a short communication distance, the effect that communications are less susceptible to disturbance is produced.

Figure 18B:
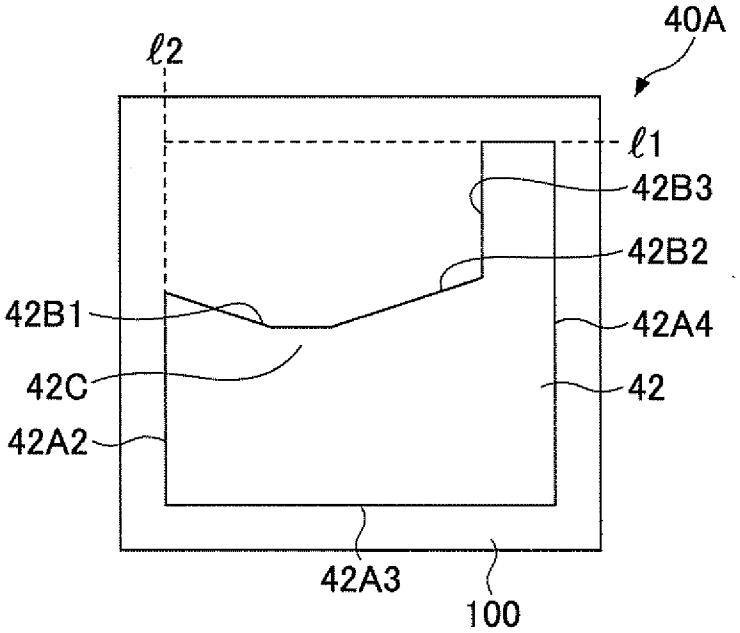
FIGS. 18A and 18B are diagrams illustrating a variation of the antenna device according to the fourth embodiment of the present invention.
Figure 18A:
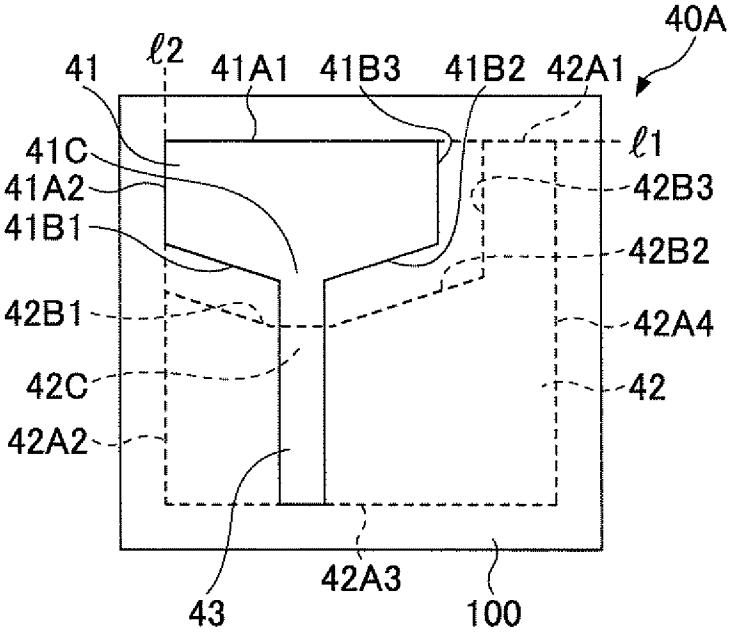
Figure 19:
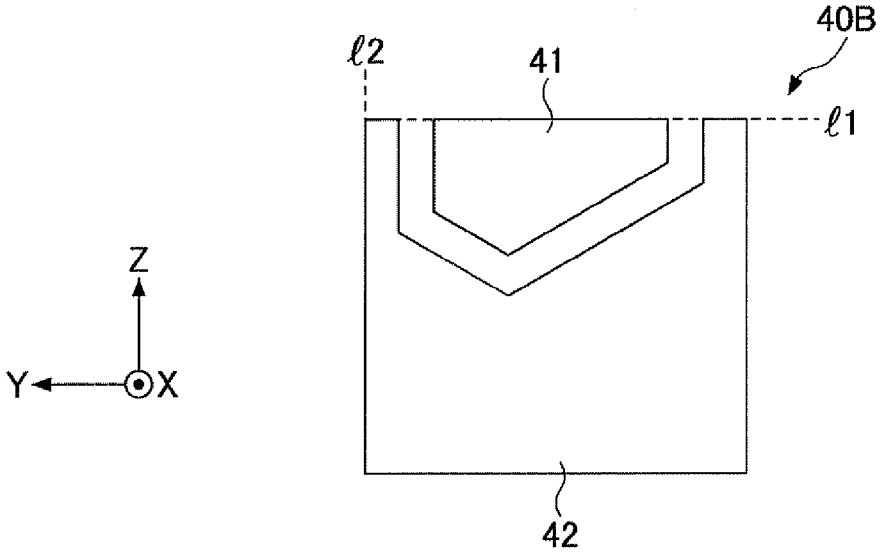
FIG. 19 is a diagram illustrating another variation of the antenna device according to the fourth embodiment of the present invention.

The antenna device 40 of this embodiment may have variations as illustrated in FIGS. 18A and 18B and FIG. 19.

According to an antenna device 40A illustrated in FIGS. 18A and 18B, the antenna element 41 further includes a microstrip line 43, which is connected to the feeding point 41C of the antenna element 41, and the ground element 42 is formed on the other (bottom) side of a substrate 100 as illustrated in FIG. 18B. Electric power is fed to the antenna element 41 via the microstrip line 43, so that the antenna device 40A has substantially the same characteristics as the antenna device 40 illustrated in FIG. 16.

Further, the home-plate shape of the antenna element 42 may be bilaterally asymmetric as in an antenna device 40B illustrated in FIG. 19. The antenna device 40B is slightly different in directivity from but has the same VSWR characteristic as the antenna device 40 illustrated in FIG. 16.

Here, a description is given of the gain characteristic of the antenna device 30 (FIG. 14) of the third embodiment and the gain characteristic of the antenna device 40 (FIG. 16) of the fourth embodiment.

Figure 20A:
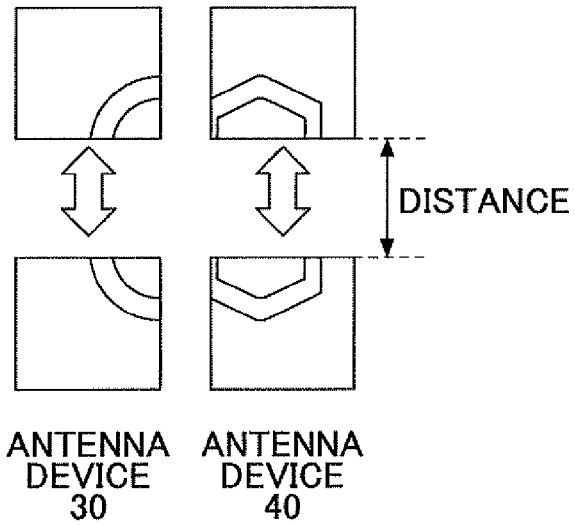
FIG. 20A is a diagram illustrating how the gain characteristics of the antenna devices of the third embodiment and the fourth embodiment of the present invention are measured.

FIG. 20A is a diagram illustrating how the gain characteristics of the antenna devices 30 and 40 are measured. As illustrated in FIG. 20A, the gain characteristic of the antenna device 30 is measured by disposing two antenna devices 30 so that their nulls (null points) face each other, and the gain characteristic of the antenna device 40 is measured by disposing two antenna devices 40 so that their nulls (null points) face each other.

Figure 20B:
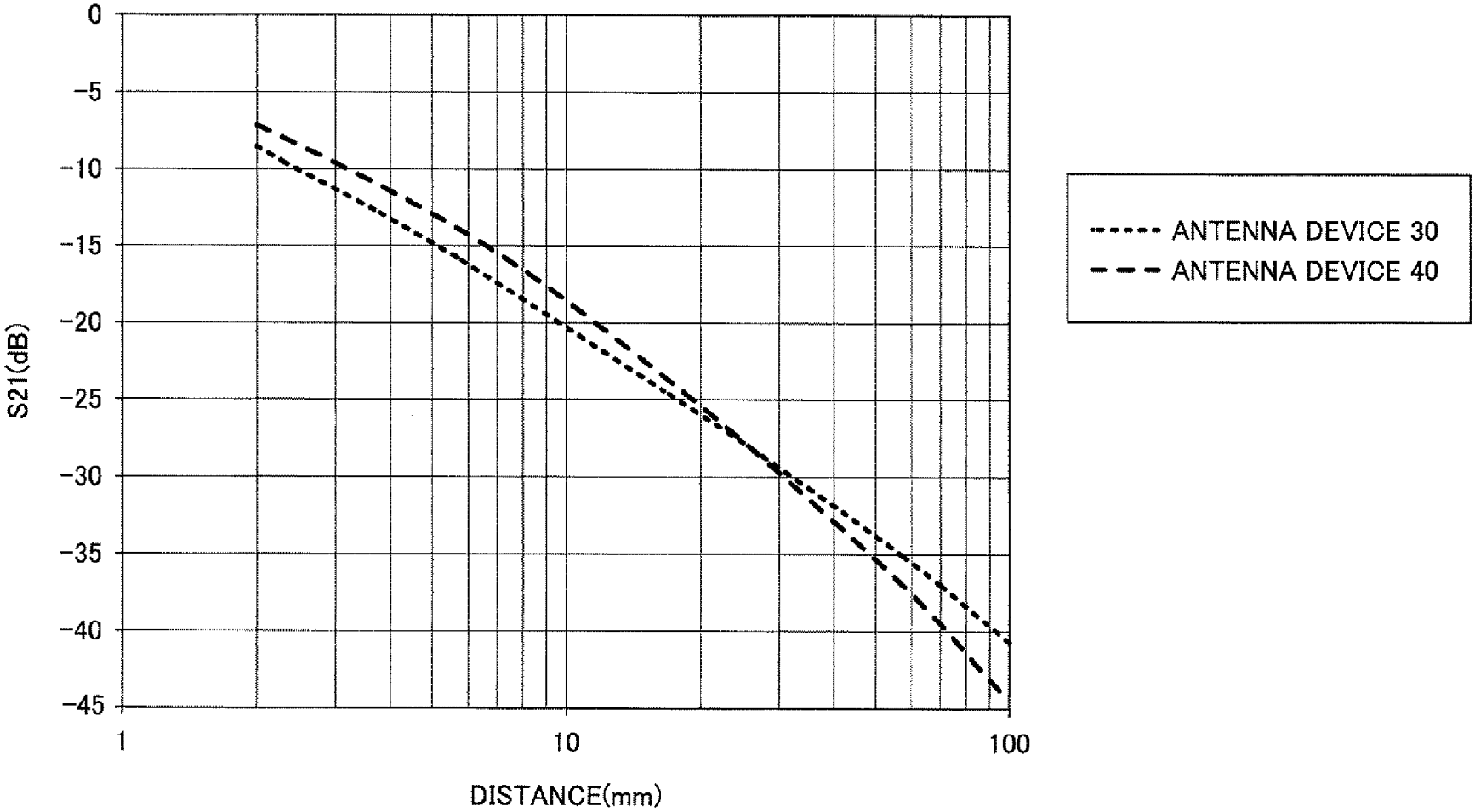
FIG. 20B is a graph illustrating the gain characteristics of the antenna devices of the third embodiment and the fourth embodiment of the present invention.

FIG. 20B is a graph illustrating the gain characteristics of the antenna devices 30 and 40.

In the case of opposing the two antenna devices 30 of the third embodiment to each other in a close range across a distance d, the $S_{21}$ parameter is approximately −7 dB in the case of d=2.0 mm, approximately −21 dB in the case of d=10.0 mm, approximately −30 dB in the case of d=30.0 mm, and approximately −41 dB in the case of d=100.0 mm.

Further, in the case of opposing the two antenna devices 40 of the fourth embodiment to each other in a close range across a distance d, the $S_{21}$ parameter is approximately −6 dB in the case of d=2.0 mm, approximately −18 dB in the case of d=10.0 mm, approximately −30 dB in the case of d=30.0 mm, and approximately −45 dB in the case of d=100.0 mm.

This shows that the antenna device 30 of the third embodiment and the antenna device 40 of the fourth embodiment are suitable for near-field communications in the z-axis directions because the obtained values are better with smaller loss than those of the comparative antenna device 1 (FIG. 6 and FIG. 8A) in the near field in the z-axis directions.

[e] Fifth Embodiment

Figure 21:
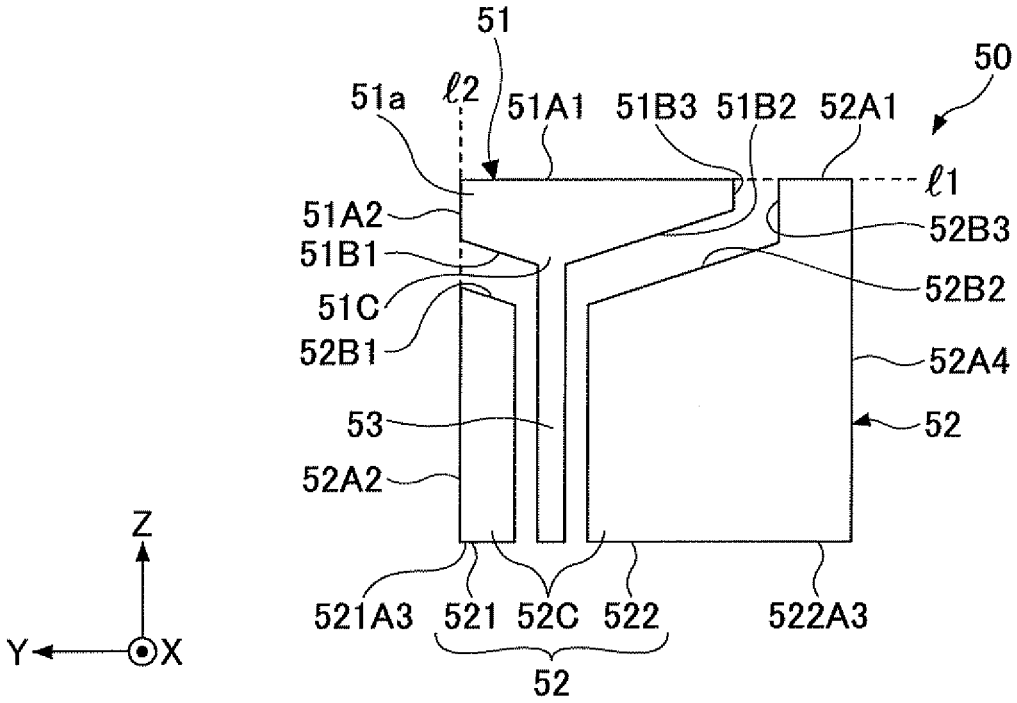
FIG. 21 is a diagram illustrating an antenna device according to a fifth embodiment of the present invention.

FIG. 21 is a diagram illustrating an antenna device 50 according to a fifth embodiment of the present invention.

In the antenna device 50 of this embodiment, the home-plate-shaped antenna element 41 of the antenna device 40A, which is a variation according to the fourth embodiment, is made asymmetric, and a ground element is divided into two portions to allow connection of a coplanar waveguide.

Referring to FIG. 21, the antenna device 50 includes an antenna element 51 having an asymmetric home-plate shape and a ground element 52 having the basic shape of a square from which a home-plate-shaped portion is cut off.

The antenna element 51 includes a body part 51*a*, a feeding point 51C, and a coplanar waveguide 53 connected to the feeding point 51C. The body part 51*a* is defined by linear sides 51A1 and 51A2 and linear sides 51B1, 51B2, and 51B3. The feeding point 51C is positioned near the intersection point of the linear sides 51B1 and 51B2.

The ground element 52 includes linear sides 52A1, 52A2, 521A3, 522A3, and 52A4, sides 52B1, 52B2, and 52B3, and ground points 52C. The ground element 52 is divided into ground element portions 521 and 522 so that the ground element portions 521 and 522 are positioned one on each side of the coplanar waveguide 53.

The linear sides 52A1 and 52A2 are positioned on the same straight lines 11 and 12 as the linear sides 51A1 and 51A2, respectively, of the antenna element 51. The linear sides 521A3 and 522A3 and the linear side 52A4 correspond to two sides of a square. The sides 52B1 through 52B3 face (are opposed to) the sides 51B1 through 51B3, respectively, of the antenna element 51. The ground points 52C are positioned across the coplanar waveguide 53 from each other near the opposed corners of the ground element portions 521 and 522 on the sides 521A3 and 522A3, respectively.

The antenna element 51 and the ground element 52 are formed on the same surface of a substrate such as a glass epoxy FR-4 substrate (not graphically illustrated).

Here, the linear side 51A1 of the antenna element 51 may be, for example, 10 mm to 25 mm in length, and the linear side 51A2 of the antenna element 51 may be, for example, 6 mm to 15 mm in length. The distance between the sides 51B1 through 51B3 of the antenna element 51 and the sides 52B1 through 52B3 of the ground element 52 may be, for example, approximately 1 mm to approximately 3 mm. For convenience of description, the ground element 52 is illustrated as a square with a home-plate-shaped cut in FIG. 21, but the basic planar shape of the ground element 52 is not limited to a square.

By thus performing feeding via the coplanar waveguide 53, it is also possible to provide the antenna device 50 for low-power communications suitable for short-distance communications like the antenna device 40 of the fourth embodiment.

Figure 22B:
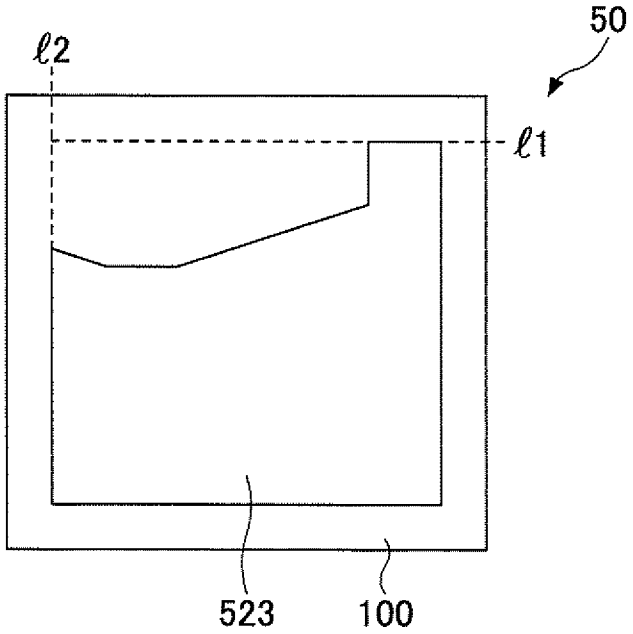
FIGS. 22A and 22B are diagrams illustrating a variation of the antenna device according to the fifth embodiment of the present invention.
Figure 22A:
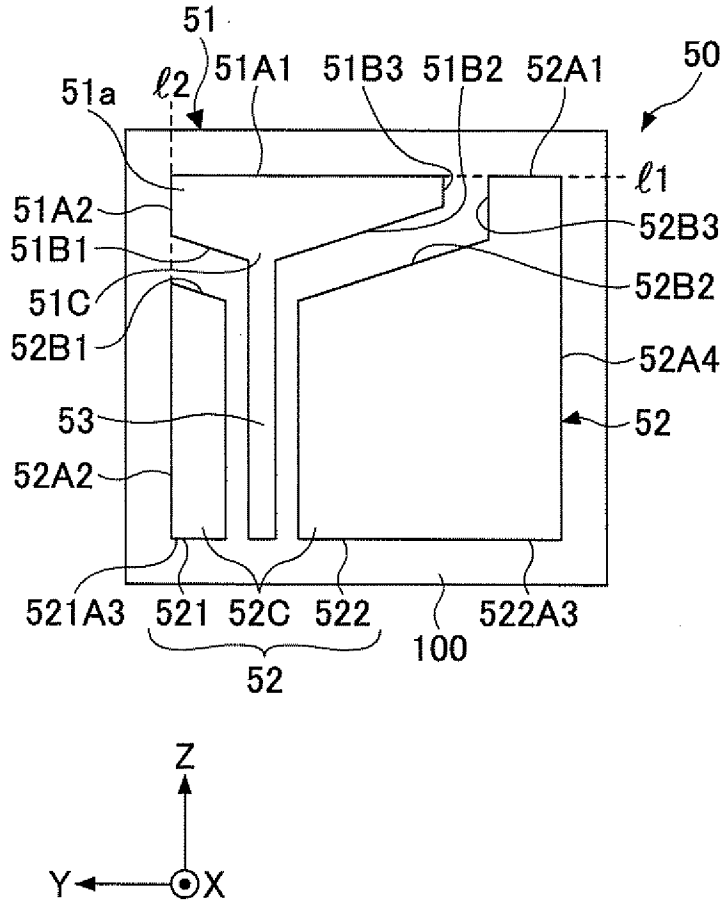

Further, as illustrated in FIGS. 22A and 22B, a ground element 523 may be formed on the other (bottom) side of the substrate 100, on which the antenna device 50 of the fifth embodiment is formed.

[f] Sixth Embodiment

Figure 23:
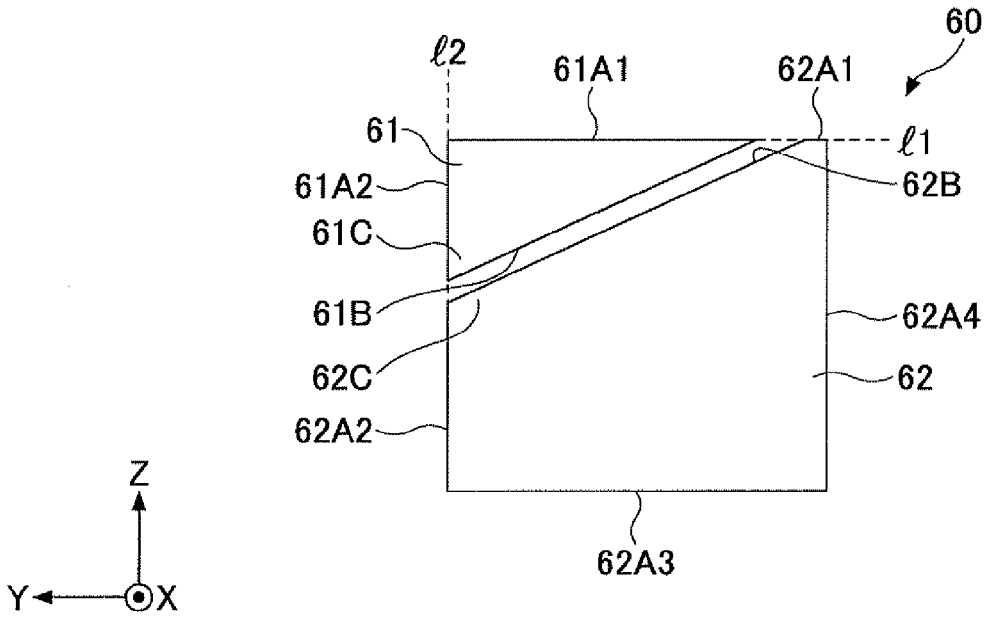
FIG. 23 is a diagram illustrating an antenna device according to a sixth embodiment of the present invention.

FIG. 23 is a diagram illustrating an antenna device 60 according to a sixth embodiment of the present invention.

According to the antenna device 60 of the sixth embodiment, the shape of the home-plate-shaped antenna element 41 of the antenna device 40 of the fourth embodiment (FIG. 16) is changed to a triangle.

Referring to FIG. 23, the antenna device 60 includes a triangular antenna element 61 and a ground element 62 having the shape of a square from which a triangular portion is cut off.

The antenna element 61 includes sides 61A1 and 61A2, a side 61B, and a feeding point 61C. The feeding point 61C is positioned near the intersection point of the sides 61A2 and 61B.

The ground element 62 includes sides 62A1, 62A2, 62A3, and 62A4, a side 62B, and a ground point 62C. The sides 62A1 and 62A2 are positioned on the same straight lines 11 and 12 as the sides 61A1 and 61A2, respectively, of the antenna element 61. The sides 62A3 and 62A4 correspond to two sides of a square. The side 62B faces (is opposed to) the side 61B of the antenna element 61. The ground point 62C is positioned near the intersection point of the side 62A2 and the side 62B.

The antenna element 61 and the ground element 62 are formed on the same surface of a substrate such as a glass epoxy FR-4 substrate (not graphically illustrated).

Here, the side 61A1 of the antenna element 61 may be, for example, 10 mm to 20 mm in length, and the side 61A2 of the antenna element 61 may be, for example, 5 mm to 10 mm in length. The distance between the side 61B of the antenna element and the side 62B of the ground element 62 may be, for example, approximately 1 mm to approximately 3 mm. For convenience of description, the ground element 62 is illustrated as a square with a triangular cut in FIG. 23, but the basic planar shape of the ground element 62 is not limited to a square.

Further, the feeding point 61C and the ground point 62C may be moved to any positions along the sides 61B and 62B, respectively. By adjusting the positions of the feeding point 61C and the ground point 62C, it is possible to adjust the VSWR characteristic in particular.

Like the antenna device 40 of the fourth embodiment, the antenna device 60 of this embodiment includes the ground element 62, which is formed (to extend) in a null direction up to a vertical position level with the null in the y-z plane of FIG. 23. Therefore, there is very little radiation of radio waves from the antenna device 60 of this embodiment in the z-axis directions and in the x-y plane directions.

This makes it possible to perform short-distance communications in a z-axis direction where a null is present.

Thus, according to the sixth embodiment, it is possible to provide the antenna device 60 for low-power communications suitable for short-distance communications by using the direction of 180° in directivity (a z-axis direction where a null is present) as the direction of communications.

[g] Seventh Embodiment

Figure 24:
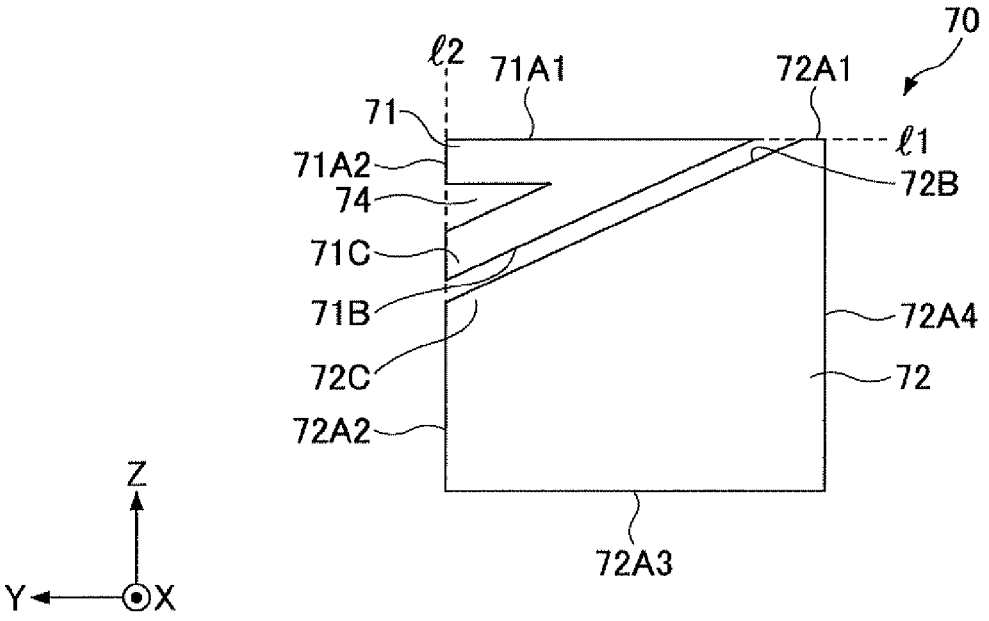
FIG. 24 is a diagram illustrating an antenna device according to a seventh embodiment of the present invention.

FIG. 24 is a diagram illustrating an antenna device 70 according to a seventh embodiment of the present invention.

The antenna device 70 may be formed by forming a cut or indentation in the antenna element 61 of the antenna device 60 of the sixth embodiment.

Referring to FIG. 24, the antenna device 70 includes a triangular antenna element 71 and a ground element 72 having the shape of a square from which a triangular portion is cut off.

The antenna element 71 includes sides 71A1 and 71A2, a side 71B, and a feeding point 71C. The feeding point 71C is positioned near the intersection point of the side 71A2 and the side 71B.

Further, the antenna element 71 includes a cut part 74. The cut part 74 is where a cut is made into the antenna element 71 in the negative y-axis direction from the side 71A2. The cut part 74 is formed to adjust a frequency characteristic (the VSWR characteristic in particular).

The ground element 72 includes sides 72A1, 72A2, 72A3, and 72A4, a side 72B, and a ground point 72C. The sides 72A1 and 72A2 are positioned on the same straight lines 11 and 12 as the sides 71A1 and 71A2, respectively, of the antenna element 71. The sides 72A3 and 72A4 correspond to two sides of a square. The side 72B faces (is opposed to) the side 71B of the antenna element 71. The ground point 72C is positioned near the intersection point of the sides 72A2 and the side 72B.

The antenna element 71 and the ground element 72 are formed on the same surface of a substrate such as a glass epoxy FR-4 substrate (not graphically illustrated).

Otherwise, the antenna device 70 has the same configuration as the antenna device 60 of the sixth embodiment.

Like the antenna device 40 of the fourth embodiment, the antenna device 70 of this embodiment includes the ground element 72, which is formed (to extend) in a null direction up to a vertical position level with the null in the y-z plane of FIG. 24. Therefore, there is very little radiation of radio waves from the antenna device 70 of this embodiment in the z-axis directions and in the x-y plane directions.

This makes it possible to perform short-distance communications in a z-axis direction where a null is present.

Thus, according to the seventh embodiment, it is possible to provide the antenna device 70 for low-power communications suitable for short-distance communications by using the direction of 180° in directivity (a z-axis direction where a null is present) as the direction of communications.

A description is given, after the description of an eighth embodiment below, of a change in a frequency characteristic due to formation of the cut part 74.

[h] Eighth Embodiment

Figure 25A:
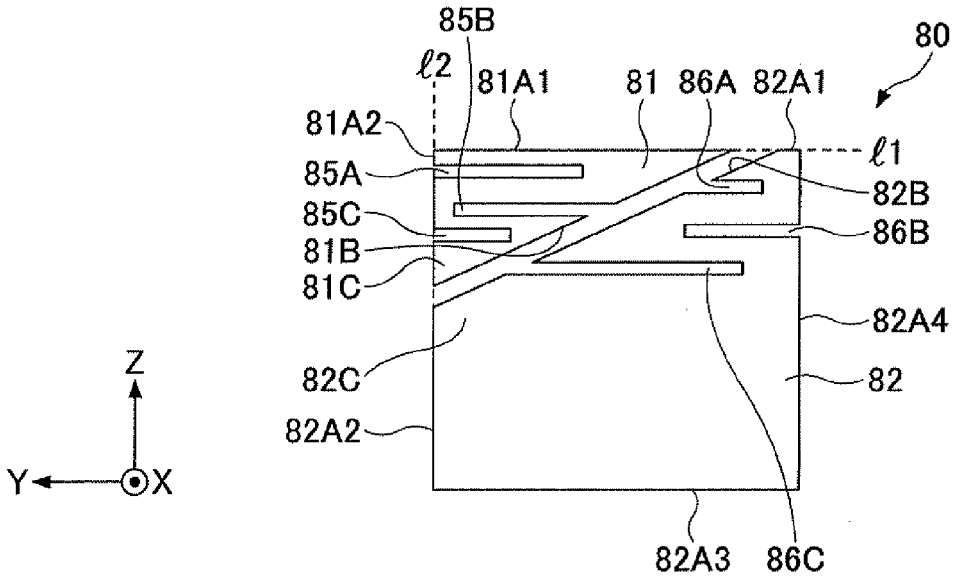
FIGS. 25A and 25B are diagrams illustrating an antenna device according to an eighth embodiment of the present invention.
Figure 25B:
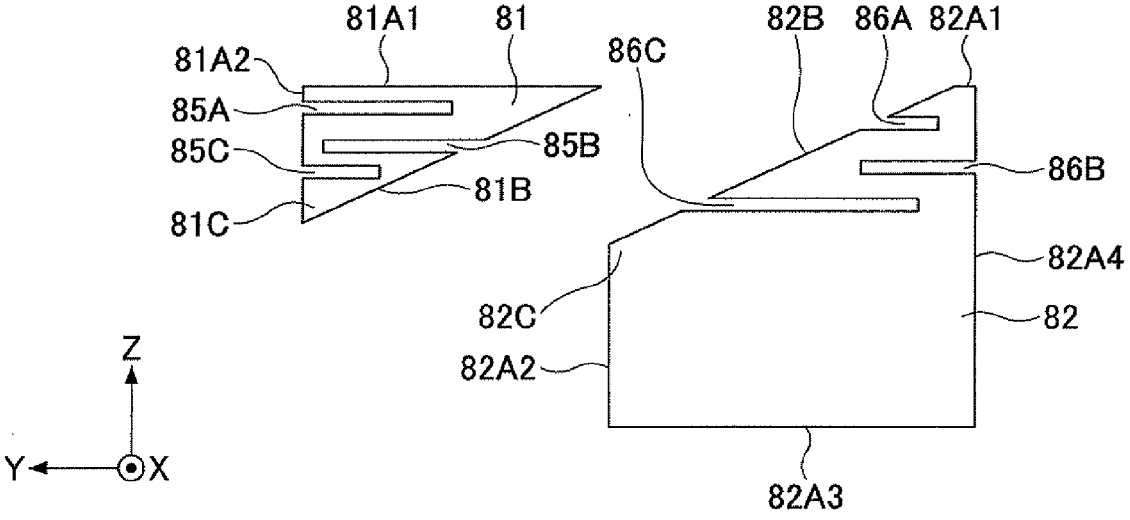

FIGS. 25A and 25B are diagrams illustrating an antenna device 80 according to the eighth embodiment of the present invention.

The antenna device 80 of the eighth embodiment is formed by forming slits in the antenna element 61 and the ground element 62 of the antenna device 60.

The antenna device 80 includes a triangular antenna element 81 and a ground element 82 having the shape of a square from which a triangular portion is cut off. For convenience of description of slits, the antenna element 81 and the ground element 82 illustrated in FIG. 25A are shown separately in FIG. 25B.

The antenna element 81 includes sides 81A1 and 81A2, a side 81B, and a feeding point 81C. The feeding point 81C is positioned near the intersection point of the side 81A2 and the side 81B.

Further, the antenna element 81 includes slits 85A, 85B, and 85C for adjusting a frequency characteristic (the VSWR characteristic in particular). The slits 85A and 85C are formed in the negative y-axis direction from the side 81A2. The slit 85B is formed in the positive y-axis direction from the side 81B.

The ground element 82 includes sides 82A1, 82A2, 82A3, and 82A4, a side 82B, and a ground point 820. The sides 82A1 and 82A2 are positioned on the same straight lines l1 and l2 as the sides 81A1 and 81A2, respectively, of the antenna element 81. The sides 82A3 and 82A4 correspond to two sides of a square. The side 82B faces (is opposed to) the side 81B of the antenna element 81. The ground point 82C is positioned near the intersection point of the side 82A2 and the side 82B.

Further, the ground element 82 includes slits 86A, 86B, and 86C. The slits 86A and 86C are formed in the negative y-axis direction from the side 82B. The slit 86B is formed in the positive y-axis direction from the side 82B.

The antenna element 81 and the ground element 82 are formed on the same surface of a substrate such as a glass epoxy FR-4 substrate (not graphically illustrated).

Otherwise, the antenna device 80 has the same configuration as the antenna device 60 of the sixth embodiment.

Like the antenna device 40 of the fourth embodiment, the antenna device 80 of this embodiment includes the ground element 82, which is formed (to extend) in a null direction up to a vertical position level with the null in the y-z plane of FIG. 25A. Therefore, there is very little radiation of radio waves from the antenna device 80 of this embodiment in the z-axis directions and in the x-y plane directions.

This makes it possible to perform short-distance communications in a z-axis direction where a null is present.

Thus, according to the eighth embodiment, it is possible to provide the antenna device 80 for low-power communications suitable for short-distance communications by using the direction of 180° in directivity (a z-axis direction where a null is present) as the direction of communications.

Figure 26:
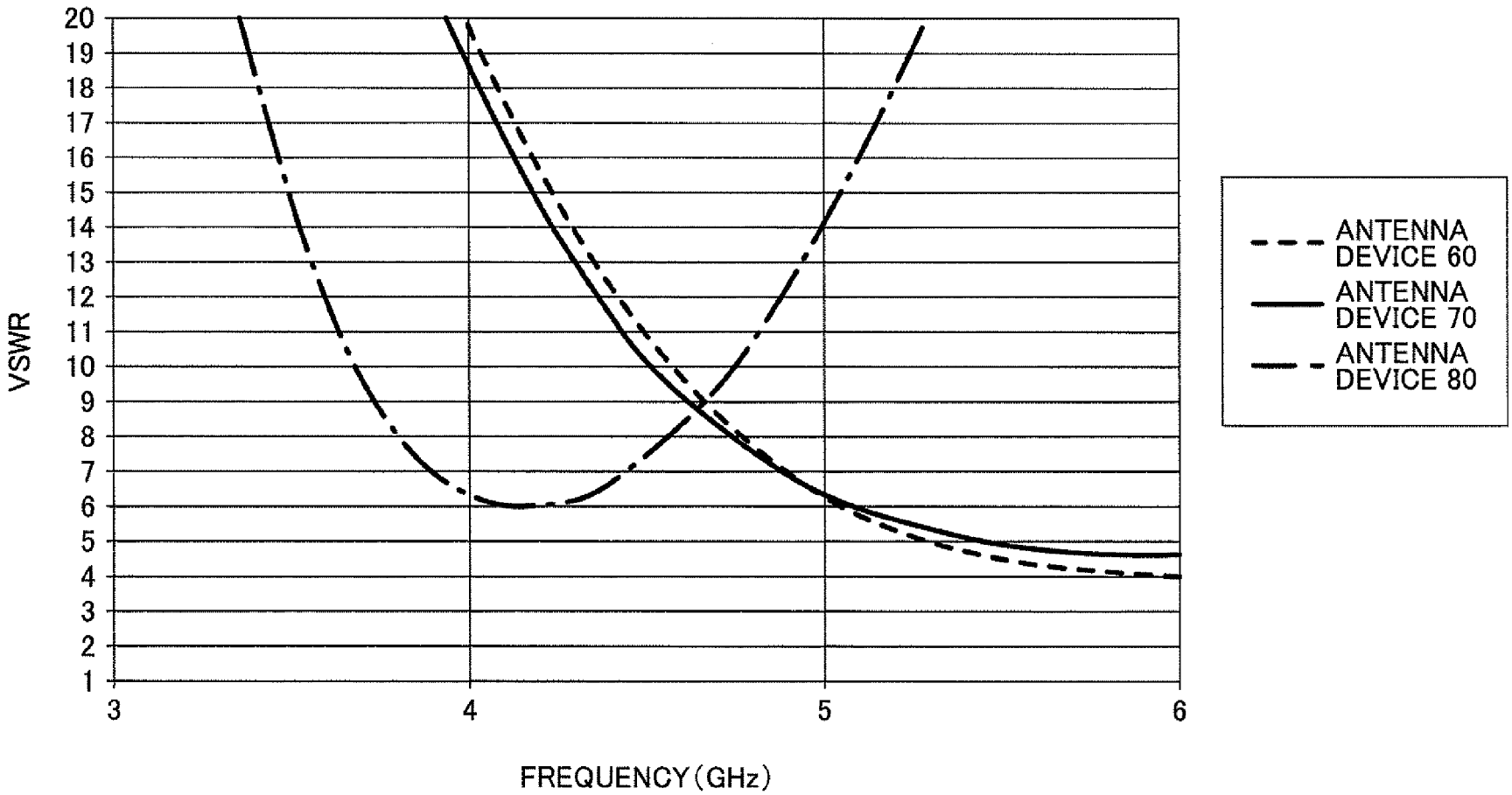
FIG. 26 is a graph illustrating the VSWR characteristics of the antenna devices of the sixth through eighth embodiments of the present invention.

Here, a description is given, with reference to FIG. 26, of the VSWR characteristics of the antenna device 60 of the sixth embodiment (FIG. 23), the antenna device 70 of the seventh embodiment (FIG. 24), and the antenna device 80 of the eighth embodiment (FIGS. 25A and 25B).

Referring to FIG. 26, the VSWR characteristics of the antenna devices 70 and 80 of the seventh and the eighth embodiment are shifted to the lower frequency side relative to the antenna device 60 of the sixth embodiment that includes neither a cut part nor a slit.

Thus, it is possible to shift the VSWR characteristic to the lower frequency side by forming the cut part 74 as in the antenna device 70 of the seventh embodiment or by forming the slits 85A through 85C and 86A through 86C as in the antenna device 80 of the eighth embodiment.

Therefore, it is possible to select a communication band by forming a cut part or a slit in an antenna device in accordance with the purpose of use of the antenna device.

Figure 27:
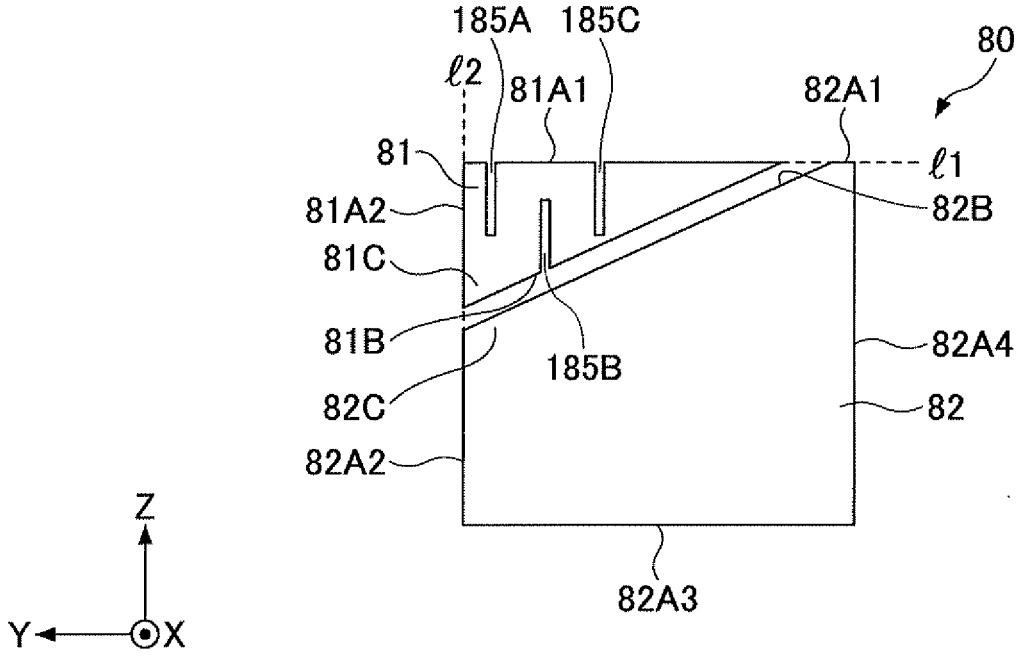
FIG. 27 is a diagram illustrating a variation of the antenna device according to the eighth embodiment of the present invention.

The positions of the slits 85A through 85C and their number and the positions of the slits 86A through 86C and their number may be determined as desired. Further, FIGS. 25A and 25B illustrate the slits 85A through 85C and 86A through 86C, which are formed in the y-axis directions. However, the slits may also be formed in the z-axis directions. FIG. 27 illustrates a variation of the antenna device 80 according to the eighth embodiment. Referring to FIG. 27, the antenna element 81 of the antenna device 80 includes slits 185A through 185C formed in the z-axis directions.

[i] Ninth Embodiment

Figure 28A:
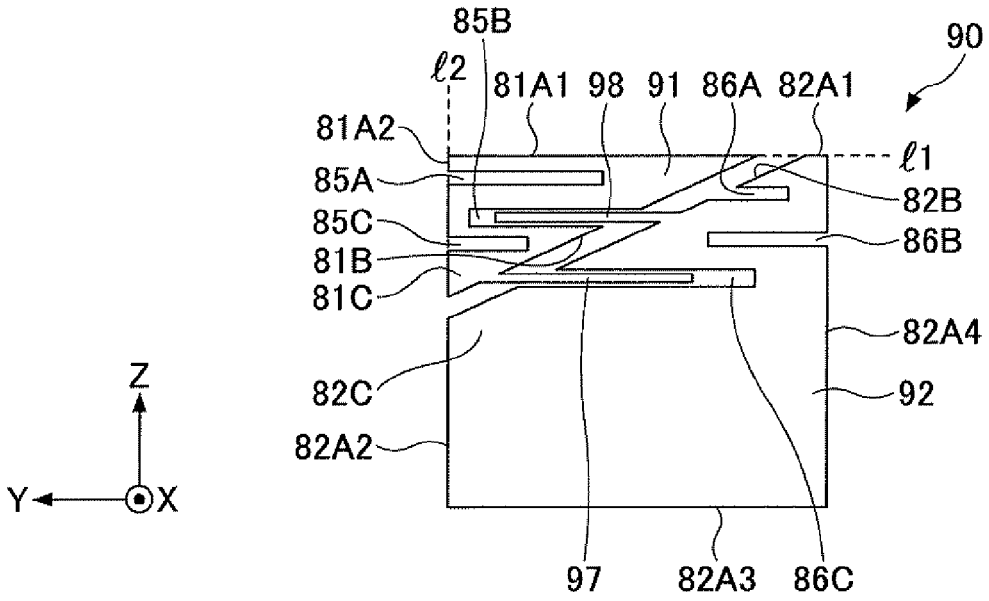
FIGS. 28A and 28B are diagrams illustrating an antenna device according to a ninth embodiment of the present invention.
Figure 28B:
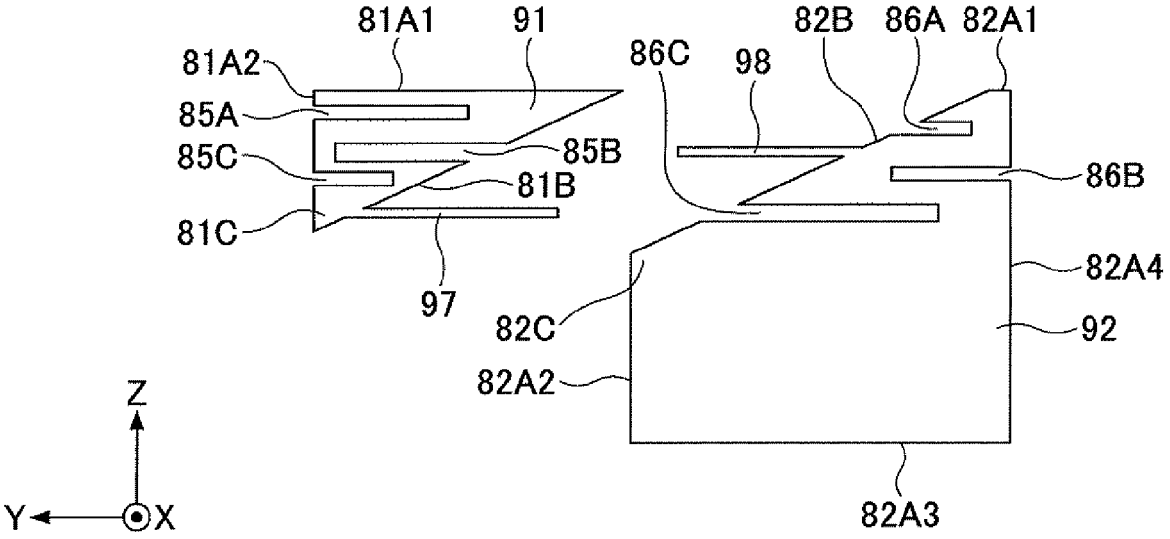

FIGS. 28A and 28B are diagrams illustrating an antenna device 90 according to a ninth embodiment of the present invention.

In addition to the configuration of the antenna device 80 of the eighth embodiment, the antenna device 90 of the ninth embodiment further includes projections that are inserted into corresponding slits.

The antenna element 90 includes a triangular antenna element 91 and a ground element 92 having the shape of a square from which a triangular portion is cut off. For convenience of description of the projections, the antenna element 91 and the ground element 92 illustrated in FIG. 28A are shown separately in FIG. 28B.

The antenna element 91 is formed by adding a projection 97 to the configuration of the antenna element 81 of the eighth embodiment. In a plan view, the projection 97 is inserted into the slit 86C of the ground element 92. The interval between the projection 97 and the slit 86C is kept uniform. Otherwise, the antenna element 91 has the same configuration as the antenna element 81 of the eighth embodiment. Accordingly, in FIGS. 28A and 28B, the same elements as those of the antenna element 81 are referred to by the same reference numerals, and a description thereof is omitted.

The ground element 92 is formed by adding a projection 98 to the configuration of the ground element 82 of the eighth embodiment. In a plan view, the projection 98 is inserted into the slit 85B of the antenna element 91. The interval between the projection 98 and the slit 85B is kept uniform. Otherwise, the ground element 92 has the same configuration as the ground element 82 of the eighth embodiment. Accordingly, in FIGS. 28A and 28B, the same elements as those of the ground element 82 are referred to by the same reference numerals, and a description thereof is omitted.

The antenna device 90 of the ninth embodiment has a VSWR characteristic that is shifted to the lower frequency side relative to the VSWR characteristic of the antenna device 80 of the eighth embodiment.

By thus forming the projections 97 and 98 as in the antenna device 90 of the ninth embodiment, it is possible to shift the VSWR characteristic to the lower frequency side.

Accordingly, it is possible to select a communication band by providing an antenna device with projections in addition to slits in accordance with the purpose of use of the antenna device.

[j] Tenth Embodiment

A description is given of a tenth embodiment of the present invention.

The tenth embodiment is different from the first through ninth embodiments in that an antenna device is mounted on a communication device.

FIGS. 29A through 29D are diagrams illustrating a communication device 101 on which an antenna device 100 is mounted.

Figure 29A:
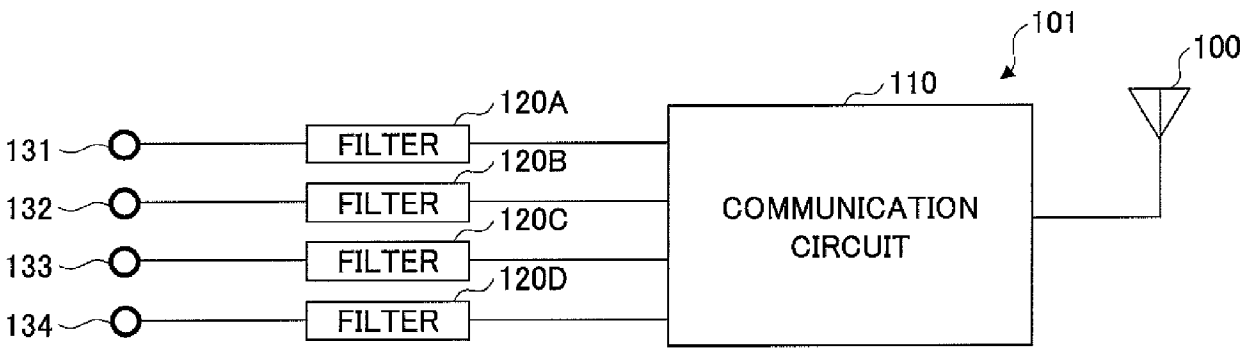
FIGS. 29A through 29D are diagrams illustrating a communication device on which an antenna device is mounted according to a tenth embodiment of the present invention.

Referring to FIG. 29A, the communication device 101, on which the antenna device 100 is mounted, includes a communication circuit 110, filters 120A, 120B, 120C, and 120D, and terminals 131, 132, 133, and 134.

Here, the antenna device 100 of this embodiment, which may be the same as the antenna device 10 of the first embodiment, includes the antenna element 11 and the ground element 12 (FIG. 1).

Further, for convenience of description, the antenna device 100 is illustrated as being externally connected to the communication device 101 in FIG. 29A. Practically, however, the ground element 12 of the antenna device 100 may be formed as the ground layer of the communication circuit 110 with the antenna element 11 of the antenna device 100 being externally connected to the communication device 101.

The filters 120A through 120D have the same circuit configuration. Accordingly, the filters 120A through 120D may be referred to collectively as "the filter 120" if the filters 120A through 120D are not distinguished in particular.

The terminals 131 and 132 are for transmitting and receiving signals necessary for the communications of the communication device 101 to and from an external apparatus. Further, the terminal 133 is for power supply, and the terminal 134 is for grounding.

Figure 29B:
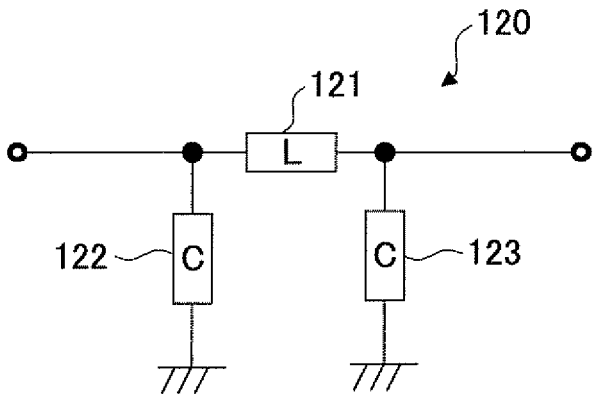

As illustrated in FIG. 29B, the filter 120, which may be a low-pass π filter, includes a coil 121 and capacitors 122 and 123 connected in a π topology.

Figure 29C:
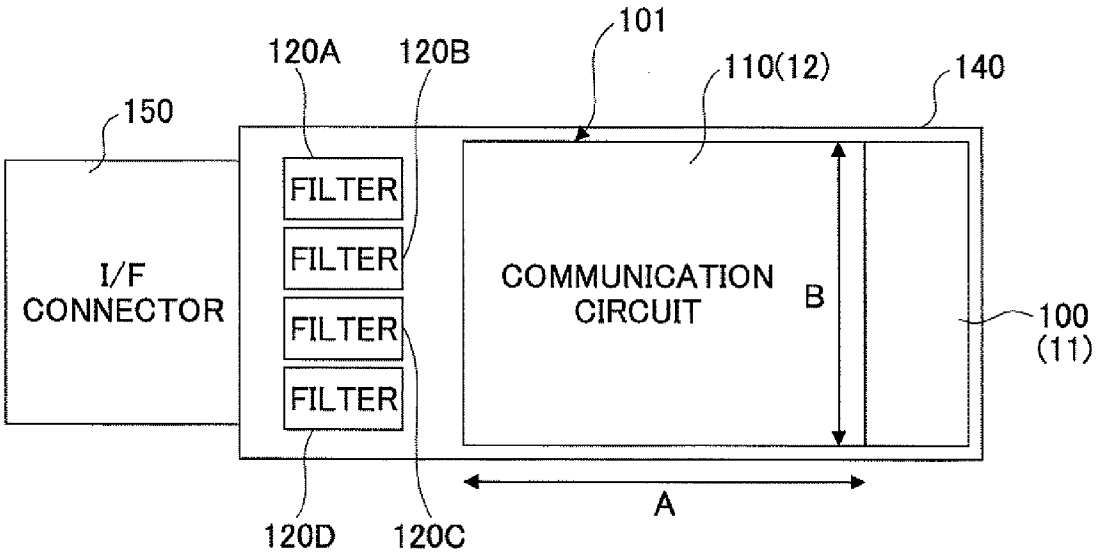
Figure 29D:
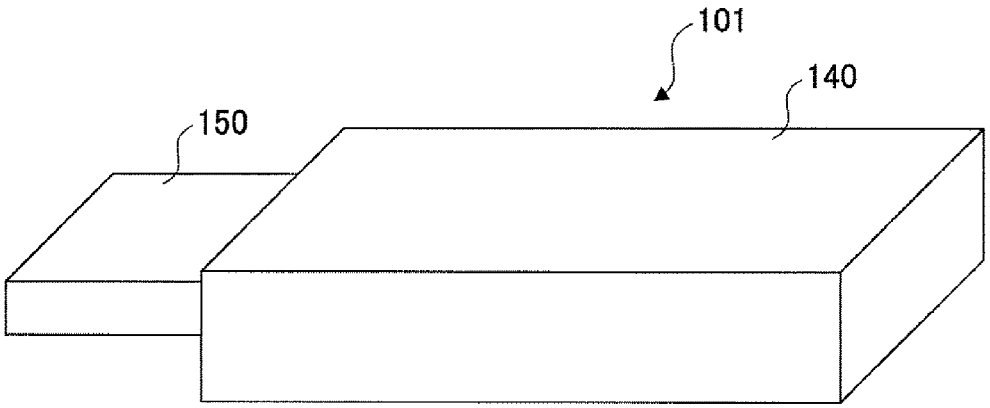

Referring to FIGS. 29C and 29D, by way of example, the communication device 101 is housed in an enclosure 140 to be connected to an interface (I/F) connector 150. The terminals 131 through 134 illustrated in FIG. 29A are connected to corresponding four USB (universal serial bus) terminals (not graphically illustrated) of the interface connector 150.

The enclosure 140 houses the antenna device 100, the communication circuit 110, and the filters 120A through 120D.

Here, it is assumed that the ground element 12 of the antenna device 100 is formed as the ground layer of the communication circuit 110 with the antenna element 11 of the antenna device 100 being externally connected to the communication device 101 as described above.

Therefore, the dimensions of the ground element 12 are determined by the dimensions of the conductive pattern (power supply pattern or ground pattern) of the communication circuit 110 indicated by arrows A and B in FIG. 29C. Further, the communication circuit 110 is separated from an external circuit such as a personal computer by the filters 120A through 120D.

According to the tenth embodiment, it is possible to perform short-distance communications by connecting the communication device 101 on which the antenna device 100 is mounted to a USB port of an external apparatus such as a personal computer. Further, since the communication circuit 110 is separated from an external circuit by the filters 120A through 120D, it is possible to prevent a variation in the communication characteristic of the antenna device 100 due to the apparent extension (toward the external circuit) of the electrical length of the ground element 12 as an element of the antenna device 100. As illustrated in FIG. 29A, the signal lines also are separated from the external circuit by the filters 120A and 120B. Accordingly, it is also possible to prevent a variation in the communication characteristic of the antenna device 100 due to the direct connection of the signal lines to the external circuit.

The antenna device 100 of this embodiment may also be the same as any of the antenna devices 20 through 90 of the second through ninth embodiments.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. A planar antenna, comprising:

an antenna element, the antenna element including a body part that has a shape symmetrical with respect to an axis of symmetry; and a feeding line that is connected to the body part and feeds the body part with electric power from an external power supply; and a ground element to be coupled to the antenna element, wherein the antenna element and the ground element are formed of a conductive film and arranged to form a rectangular shape with at least one gap between the antenna element and the ground element, wherein three adjacent sides of the ground element are aligned to three sides of the perimeter of the rectangular shape, wherein the body part has a shape of one of a polygon, a circle, a part of a polygon and a part of a circle, wherein a first side of the body part and a first side of the ground element are aligned with a fourth side of the perimeter of the rectangular shape, wherein the gap is open on the fourth side, wherein the antenna element and the ground element are formed on a same surface of a substrate, wherein the feeding line is one of a microstrip line and a coplanar waveguide, and extends linearly on the axis of symmetry from the body part to a side of the rectangular shape opposite to said fourth side so as to divide the ground element into a first portion and a second portion, wherein the at least one gap is defined by a second side of the body part and a second side of the ground element, and wherein the second side of the body part has a first end on the fourth side of the rectangular shape and a second end opposite to the first end, and a distance between the second side of the ground element and the second side of the body part from the first end to the second end thereof is uniform.

2. The planar antenna as claimed in claim 1, further comprising:

an additional ground element formed on another surface of the substrate facing away from the same surface, wherein the feeding line is the microstrip line.

3. The planar antenna as claimed in claim 1, further comprising:

a feeding part provided on the feeding line and fed with the electric power from the external power supply.

4. The planar antenna as claimed in claim 1, wherein each of the antenna element and the ground element has a flat-plate shape.

5. The planar antenna as claimed in claim 1, wherein the antenna element and the ground element are formed directly on the same surface of the substrate.

* * * * *